US008083311B2

(12) United States Patent
Ide et al.

(10) Patent No.: US 8,083,311 B2
(45) Date of Patent: Dec. 27, 2011

(54) INK-JET PRINTING APPARATUS, CONTROL METHOD THEREFOR, PROGRAM, AND STORAGE MEDIUM

(75) Inventors: Daisaku Ide, Tokyo (JP); Hirokazu Yoshikawa, Kawasaki (JP); Hitoshi Nishikori, Tokyo (JP); Takeshi Yazawa, Yokohama (JP); Atsuhiko Masuyama, Tokyo (JP); Akiko Maru, Kawasaki (JP); Hideaki Takamiya, Kawasaki (JP); Hiroshi Tajika, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 525 days.

(21) Appl. No.: 12/233,295

(22) Filed: Sep. 18, 2008

(65) Prior Publication Data

US 2009/0051725 A1 Feb. 26, 2009

Related U.S. Application Data

(63) Continuation of application No. 11/396,457, filed on Apr. 4, 2006, now Pat. No. 7,445,309.

(30) Foreign Application Priority Data

Apr. 5, 2005 (JP) ..... 2005-109223

(51) Int. Cl.
*B41J 29/38* (2006.01)

(52) U.S. Cl. ..... 347/17; 347/22; 347/23; 347/24; 347/29; 347/30

(58) Field of Classification Search ..... None
See application file for complete search history.

(56) References Cited

U.S. PATENT DOCUMENTS

| | | | | |
|---|---|---|---|---|
| 5,625,385 | A | 4/1997 | Suzuki | 347/24 |
| 5,805,180 | A | 9/1998 | Ebisawa et al. | 347/23 |
| 5,896,143 | A | 4/1999 | Matsui et al. | 347/24 |
| 5,903,287 | A | 5/1999 | Ishikawa et al. | 347/24 |
| 6,000,778 | A | 12/1999 | Koitabashi et al. | |
| 6,145,956 | A | 11/2000 | Koitabashi et al. | |
| 6,494,560 | B1 | 12/2002 | Seshimo et al. | 347/23 |
| 6,527,361 | B1 | 3/2003 | Gotoh et al. | |
| 6,669,326 | B2 | 12/2003 | Yazawa et al. | |
| 2005/0174382 | A1 | 8/2005 | Yoshikawa et al. | |

FOREIGN PATENT DOCUMENTS

| | | |
|---|---|---|
| JP | 04-214358 | 8/1992 |
| JP | 07-017058 | 1/1995 |
| JP | 2001-138552 | 5/2001 |
| JP | 2005-001130 | 1/2005 |
| JP | 2002-347260 | 12/2005 |

*Primary Examiner* — Matthew Luu
*Assistant Examiner* — Justin Seo
(74) *Attorney, Agent, or Firm* — Fitzpatrick, Cella, Harper & Scinto

(57) ABSTRACT

An object of this invention is to prevent prolongation of the time taken for a suction recovery operation while suppressing wasteful consumption of ink in the suction recovery operation. An ink-jet printing apparatus includes a plurality of caps which, when a plurality of nozzles of an ink-jet head are divided into a plurality of nozzle groups, are arranged one by one for the respective nozzle groups, and cap the respective nozzle groups, a suction pump which generates a negative pressure in the plurality of caps to suck ink from the plurality of nozzles, and is arranged commonly for the plurality of caps, and a control unit which controls the suction pump so as to make the negative pressure by the suction pump act on all the caps when a common negative pressure is generated in the plurality of caps, and make different negative pressures by the suction pump act sequentially on the plurality of caps when different negative pressures are generated in the respective caps.

4 Claims, 16 Drawing Sheets

INK-JET PRINTING APPARATUS, CONTROL METHOD THEREFOR, PROGRAM, AND STORAGE MEDIUM

This is application is a continuation of U.S. patent application Ser. No. 11/396,457 filed on Apr. 4, 2006.

FIELD OF THE INVENTION

The present invention relates to a maintenance technique in an ink-jet printing apparatus.

BACKGROUND OF THE INVENTION

An ink-jet printing apparatus is a system which converts input image data into an output image via a liquid, i.e., ink. In this apparatus, its maintenance technique is a very important factor. Main reasons for the necessity of maintenance will be briefly explained.

(a) When input image data is printed, ink evaporates at discharge orifices which do not discharge ink among a plurality of nozzles arrayed on an ink-jet printhead. The ink viscosity in the discharge orifices increases, and no ink can be stably discharged by normal ink discharge energy, resulting in a discharge failure.

(b) During printing, ink droplets discharged from nozzles include small ink droplets (to be also referred to as a mist) in addition to main ink droplets. Small ink droplets attach around the ink discharge orifices of the ink-jet printhead, inhibiting straight ink discharge.

(c) If bubbles exist in an ink reservoir in the ink-jet printhead, gas having passed through discharge orifices and the material of the ink-jet printhead is entrapped in bubbles and grows, or bubbles expand upon temperature rise in printing. As a result, ink supply from an ink tank is inhibited, causing a printing failure.

As a maintenance technique which solves problems (a) to (c), there are known the following techniques.

(a) In accordance with the time and environment in which ink is not discharged and is left standing, a predetermined amount of ink is discharged in addition to ink discharge based on image data, and high-viscosity ink is discharged (this operation will be called preliminary discharge hereinafter).

(b) The discharge count at which ink droplets are discharged from discharge orifices is counted. When the count exceeds a predetermined value, a surface (to be referred to as a face hereinafter) of the ink-jet printhead in which discharge orifices are formed is wiped with a rubber blade or the like to remove attached ink (this operation will be called wiping hereinafter).

(c) A recovery operation is performed to suck ink from discharge orifices by using a pump and discharge. ink from the discharge orifices (this operation will be called suction recovery hereinafter). In an ink-jet printing apparatus in which an ink-jet printhead and ink tank can be separated and the ink tank can be exchanged, suction recovery is executed even after the ink tank is exchanged.

The wiping operation and suction recovery operation will be briefly explained with reference to the accompanying drawings.

FIG. 1 is a view for explaining the. wiping operation. Reference numeral 1101 denotes a rubber blade which wipes; 1102, a face to be wiped; 1103, an ink discharge orifice (ink discharge nozzle); 1104, attached ink which inhibits discharge; and 1105, a wiring direction. Wiping is to, while pressing the rubber blade 1101 against the ink-jet printhead, move the rubber blade 1101 in the direction 1105, bring the blade into contact with the attached ink 1104, and wipe the attached ink 1104 from the face, as shown in FIG. 1.

FIG. 2 is a view for explaining the suction recovery operation. Reference numeral 1201 denotes an ink-jet printhead; 1202, an ink discharge nozzle; 1203, a face; 1204, a suction cap; 1205, an ink discharge tube; and 1206, a suction pump which generates a negative pressure for sucking ink. In suction recovery, the suction cap 1204 generally made of rubber is abutted or pressed against the face 1203 and tightly contacts with it. The suction pump 1206 is pivoted in a direction indicated by an arrow 1207 to generate a negative pressure. Ink in the ink-jet printhead 1201 is sucked from the ink discharge nozzle (ink discharge orifice) 1202 into the suction cap 1204, and discharged from the ink discharge tube 1205.

In recent ink-jet printing apparatuses to which higher image qualities and higher speeds are required, the number of types of inks used and the number of discharge orifices for discharging ink abruptly increase from those several years ago. In this situation, the maintenance technique becomes more important.

An increase in image quality of recent ink-jet printing apparatuses will be explained in short.

The ink-jet printing apparatus is originally configured to form an image by superposing images of three primary colors by so-called subtractive color mixture of cyan ink, magenta ink, and yellow ink.

In addition to these three color inks, black ink capable of expressing a high contrast, and light inks (light cyan ink and light magenta ink) prepared by decreasing the content of a coloring material in order to improve tone reproduction are used. Also, a technique of minimizing discharge ink droplets in order to reduce graininess of an output image is introduced. These measures make it possible to form a high-quality image.

In order to further increase the image quality, a special ink (color other than cyan, magenta, and yellow) for expressing a color gamut which cannot be reproduced by the above-mentioned six color inks is used. A color pigment ink which improves conservation of an output image is used. There is also known a liquid which improves glossiness by applying the liquid before or after discharging ink to a printing medium.

An example of increasing the image quality, there is known an ink-jet printing apparatus in which inks of orange and green for widening the reproducible color gamut are mounted in addition to inks of black, cyan, magenta, yellow, light cyan, and light magenta (see Japanese Patent Application Laid-Open No. 2001-138552).

As described above, only one suction cap 1204 is used as shown in FIG. 2 in maintenance technique (c) when various types of inks are employed to increase the image quality. If the number of ink types is, e.g., eight, suction recovery is executed for all ink tanks of the eight colors every time an ink tank of one color is exchanged, excessively consuming ink.

As a method of solving this problem, the ink discharge nozzle building portion in one ink-jet head 2001 is divided into a plurality of nozzle portions, e.g., a first nozzle portion 2003, second nozzle portion 2005 , . . . , as shown in FIG. 3. The respective nozzle portions are independently equipped with suction caps 2007, 2009, . . . . The count and timing at which the suction recovery operation is performed can be changed for the respective nozzle portions 2003, 2005.

This arrangement can minimize a redundant ink amount which is consumed in exchanging an ink tank, suction recovery at an early timing, or the like. The total consumption of ink in the whole apparatus including the consumption of ink in suction recovery can be reduced.

However, when the number of ink tanks which store ink to be supplied to divided discharge nozzle portions, the ink supply channel (pipe structure for supplying ink) extending from the ink tank to the ink discharge portion, and the like change between divided discharge nozzle portions, an optimal negative suction pressure and ink flow rate necessary for suction recovery at each discharge nozzle portion may change.

Even if a suction cap is prepared for each nozzle portion, only one suction pump is generally arranged to avoid increases in size and cost of the apparatus. In this case, ink discharge tubes connected to respective suction caps are connected to the same suction pump. The ink discharge tubes which connect the corresponding suction caps to the suction pump are identical (same diameter, same material, and the like), so negative pressures and ink flow rates which are generated upon driving the suction pump once are equal to each other. To perform the recovery operation at the respective discharge nozzle portions in this arrangement, an air communication valve between the suction pump and each cap is opened/closed to switch the ink discharge tube connected to the suction pump and perform suction recovery sequentially for the respective discharge nozzle portions.

For this reason, when the optimal negative suction pressure and ink flow rate that are necessary for suction recovery change between the discharge nozzle portions, suction recovery must be sequentially done under pump driving conditions optimal for each discharge nozzle portion in order to generate an optimal negative suction pressure and ink flow rate at each discharge nozzle portion. The time taken for suction recovery becomes long in accordance with the number of discharge nozzle portions, and the user suffers extra stress.

SUMMARY OF THE INVENTION

The present invention has been made to overcome the conventional drawbacks, and has as its object to prevent prolongation of the time taken for a suction recovery operation while suppressing wasteful consumption of ink in the suction recovery operation.

To solve the above problems and achieve the above object, according to the first aspect of the present invention, an ink-jet printing apparatus which prints by discharging ink from a plurality of nozzles of an ink-jet head having the plurality of nozzles is characterized by comprising a plurality of capping devices which, when the plurality of nozzles are divided into a plurality of nozzle groups, are arranged one by one for the respective nozzle groups, and cap the respective nozzle groups, a suction device which generates a negative pressure in the plurality of capping devices to suck ink from the plurality of nozzles, and is arranged commonly for the plurality of capping devices, a switching device which switches whether to make the negative pressure by the suction device act on the respective capping devices, and a control device which controls the switching device and the suction device so as to make the negative pressure by the suction device act on all the capping devices when a common negative pressure is generated in the plurality of capping devices, and make different negative pressures by the suction device act sequentially on the plurality of capping devices when different negative pressures are generated in the respective capping devices.

According to the second aspect of the present invention, a method of controlling an ink-jet printing apparatus including a plurality of capping devices which, when a plurality of nozzles of an ink-jet head are divided into a plurality of nozzle groups, are arranged one by one for the respective nozzle groups, and cap the respective nozzle groups, a suction device which generates a negative pressure in the plurality of capping devices to suck ink from the plurality of nozzles, and is arranged commonly for the plurality of capping devices, and a switching device which switches whether to make the negative pressure by the suction device act on the respective capping devices is characterized by comprising a control step of controlling the switching device and the suction device so as to make the negative pressure by the suction device act on all the capping devices when a common negative pressure is generated in the plurality of capping devices, and make different negative pressures by the suction device act sequentially on the plurality of capping devices when different negative pressures are generated in the respective capping devices.

According to the third aspect of the present invention, a program is characterized by causing a computer to execute the above-described control method.

According to the fourth aspect of the present invention, a storage medium is characterized by computer-readably storing the above-described program.

Other objects and advantages besides those discussed above shall be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Preferred embodiments of the present invention will be described in detail below with reference to the accompanying drawings.

Note that the following embodiments will exemplify a printing apparatus using an ink-jet printhead.

In this specification, "printing" (to be also referred to as "print") has a broad meaning of forming an image, design, pattern, or the like on a printing medium or processing a medium regardless of whether to form significant information such as a character or figure, whether information is significant or insignificant, or whether information is so visualized as to allow the user to visually perceive it.

"Printing media" are not only paper used in a general printing apparatus, but also ink-receivable materials such as cloth, plastic film, metal plate, glass, ceramics, wood, and leather in a broad sense.

"Ink" (to be also referred to as "liquid") should be interpreted as widely as the definition of "printing (print)". "Ink" represents a liquid which is applied to a printing medium to form an image, design, pattern, or the like, process the printing medium, or contribute to ink processing (e.g., solidification or insolubilization of a coloring material in ink applied to a printing medium).

"Nozzles" comprehensively mean discharge orifices or liquid channels which communicate with them, and elements which generate energy used to discharge ink, unless otherwise specified.

First Embodiment (Arrangement of Mechanical Part)

The arrangement of the mechanical part of a printing apparatus according to the first embodiment of the present invention will be explained. The printing apparatus main body in the first embodiment can be roughly classified by the role of each mechanism into a sheet feed section, paper convey section, delivery section, carriage section, cleaning section, and exterior section.

Figure 1:
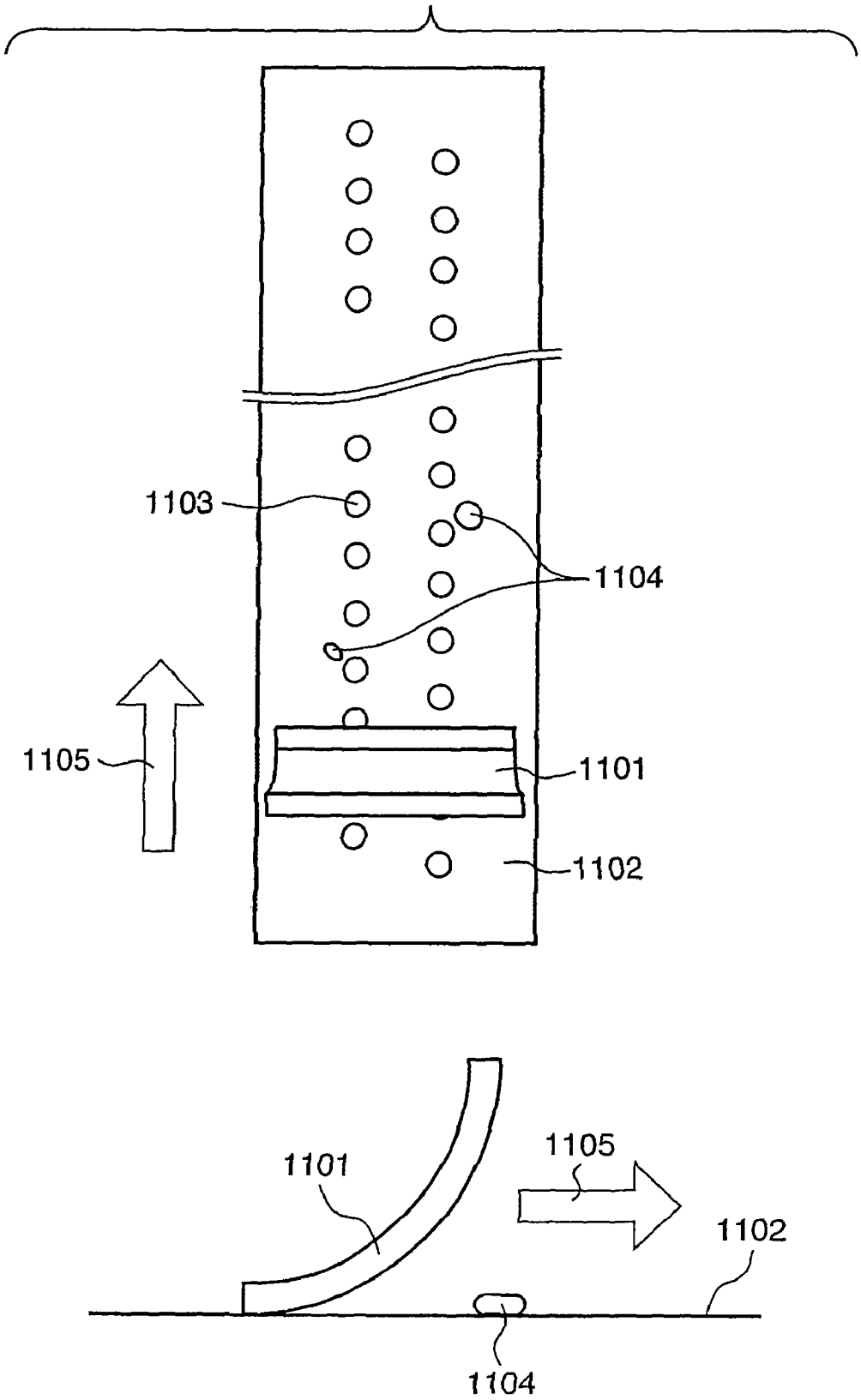
FIG. 1 is a view for explaining the wiping operation of an ink-jet head.
Figure 2:
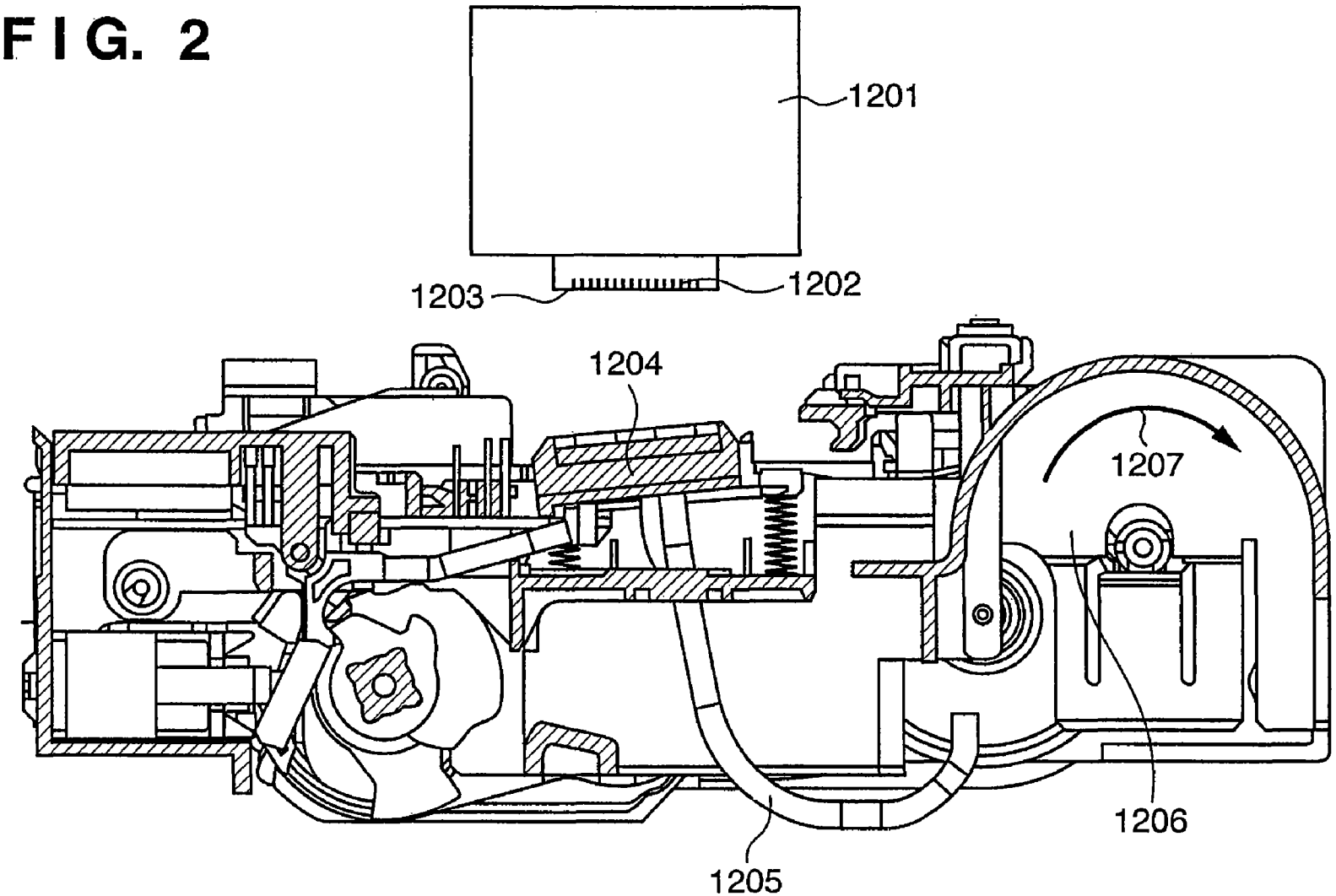
FIG. 2 is a view for explaining the suction recovery operation of the ink-jet head.
Figure 3:
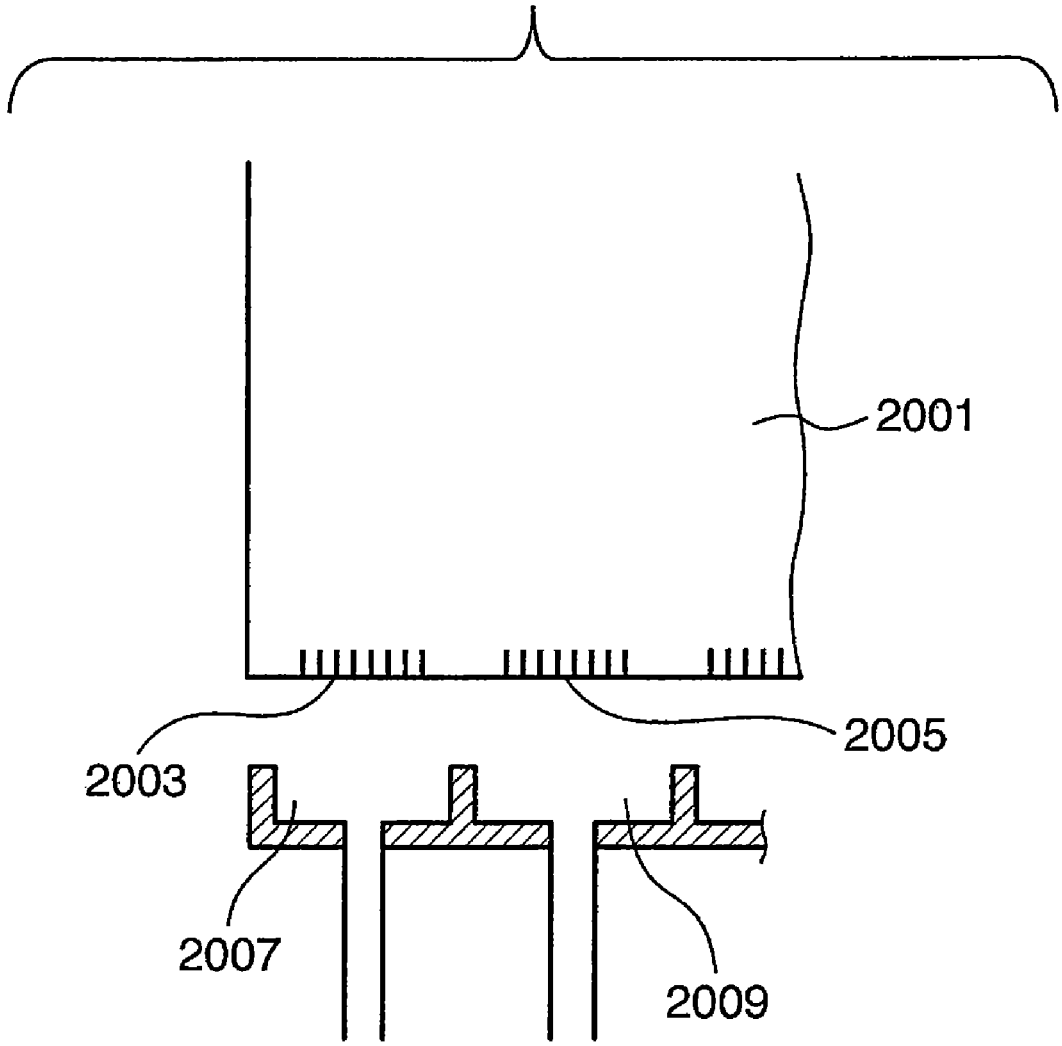
FIG. 3 is a view showing an example of arranging a suction cap for each divided nozzle portion.
Figure 4:
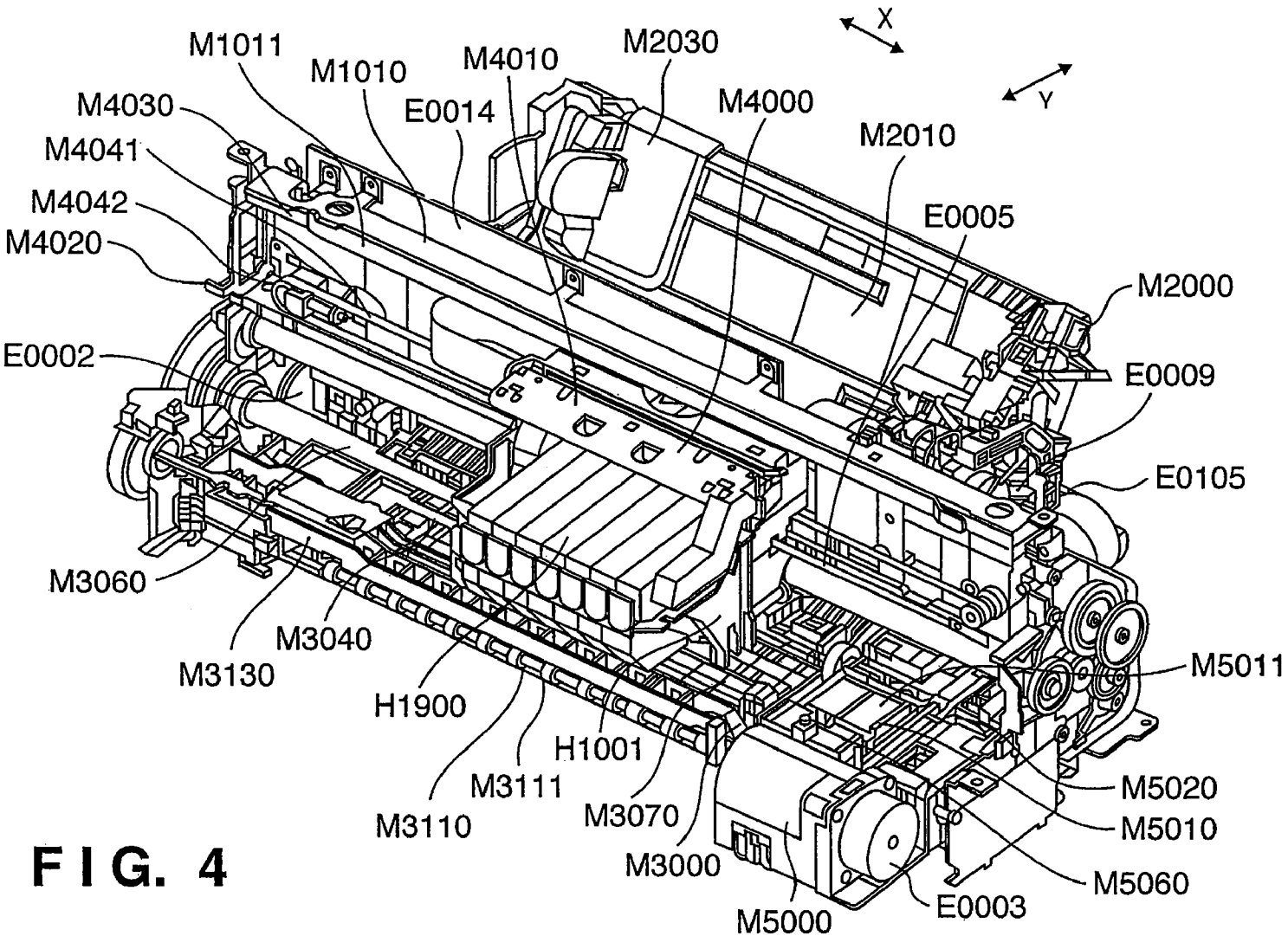
FIG. 4 is a perspective view showing the structure of the mechanical part of a printing apparatus according to the first embodiment of the present invention.

FIG. 4 is a perspective view showing the arrangement of the overall printing apparatus main body. Note that the present invention is related to the suction recovery operation of the ink-jet printhead, and the arrangement of the cleaning section will be mainly explained.

(Overall Arrangement)

As described above, the present invention is related to the suction recovery operation of the ink-jet printhead according to the present invention, and only the names of the respective sections will be described for the overall arrangement.

In FIG. 4, reference symbol M1010 denotes a chassis; M1011, a guide rail; M2000, a base; M2010, a stacker; M2030, a movable side guide; M3000, a pinch roller holder; M3040, a platen; M3060, a conveyance roller; M3070, a pinch roller; M3110, delivery roller; M3111, an elastic member; M3130, a spur holder; M4000, a carriage; M4010, a head set lever; M4020, a guide shaft; M4030, a sliding sheet; M4041, a timing belt; M4042, an idle pulley; M5000, a pump; M5010, a suction cap; M5011, a cap absorber; M5020, blades; M5060, a blade cleaner; E0002, an LF motor; E0005, an encoder scale; E0009, an ASF sensor; E0014, a main substrate; and E0105, an ASF motor.

(Cleaning Section)

The cleaning section is made up of the pump M5000 for cleaning an ink-jet printhead H1001, the cap M5010 for suppressing drying of the ink-jet printhead H1001, and the blades M5020 for cleaning the discharge orifice forming surface of the ink-jet printhead H1001.

The cleaning section is equipped with a dedicated cleaning motor E0003. The cleaning motor E0003 has a one-way clutch (not shown). The pump M5000 is driven by rotation in one direction, and the blades M5020 are driven by rotation in the opposite direction. At the same time, the cap M5010 moves up and down.

The pump M5000 is configured to generate a negative pressure by squeezing two tubes (not shown) by pump rollers (not shown). The cap M5010 is connected to the pump M5000 via a valve (not shown) or the like. While the cap M5010 is in tight contact with the ink discharge orifice of the ink-jet printhead H1001, the pump M5000 is operated to suck unnecessary ink or the like from the ink-jet printhead H1001. The cap absorber M5011 is attached to the inner portion of the cap M5010 in order to reduce ink remaining on the face of the ink-jet printhead H1001 after suction. While the cap M5010 is open, ink remaining in the cap M5010 is sucked to prevent fixation of residual ink and a subsequent harmful effect. Ink sucked by the pump M5000 is treated as waste ink, and sucked and held in a waste ink absorber arranged in the lower case (exterior) of the printing apparatus main body.

A series of operations which are successively executed, for example, the operation of the blades M5020, elevation of the cap M5010, and opening/closing of the valve (not shown), is controlled by a main cam (not shown) having a plurality of cams on the shaft. The cams and arms at respective portions can perform predetermined operations in synchronism with the main cam. The rotational position of the main cam can be detected by a position detection sensor such as a photointerrupter. When the cap M5010 is moved down, the blades M5020 move perpendicularly to the scanning direction of the carriage M4000, and clean the face of the ink-jet printhead H1001. The blades M5020 are classified into ones which clean the vicinity of the nozzle of the ink-jet printhead H1001, and ones which clean the entire face. When the carriage M4000 moves to the innermost portion, it abuts against the blade cleaner M5060 to remove ink and the like attached to the blades M5020 themselves.

(Arrangement of Ink-Jet Printhead)

The arrangement of a head cartridge H1000 used in the first embodiment will be described. The head cartridge H1000 in the first embodiment comprises the ink-jet printhead H1001, a mechanical portion which supports an ink tank H1900, and a mechanical portion which supplies ink from the ink tank H1900 to the ink-jet printhead H1001. The head cartridge H1000 is detachably mounted on the carriage M4000.

Figure 5:
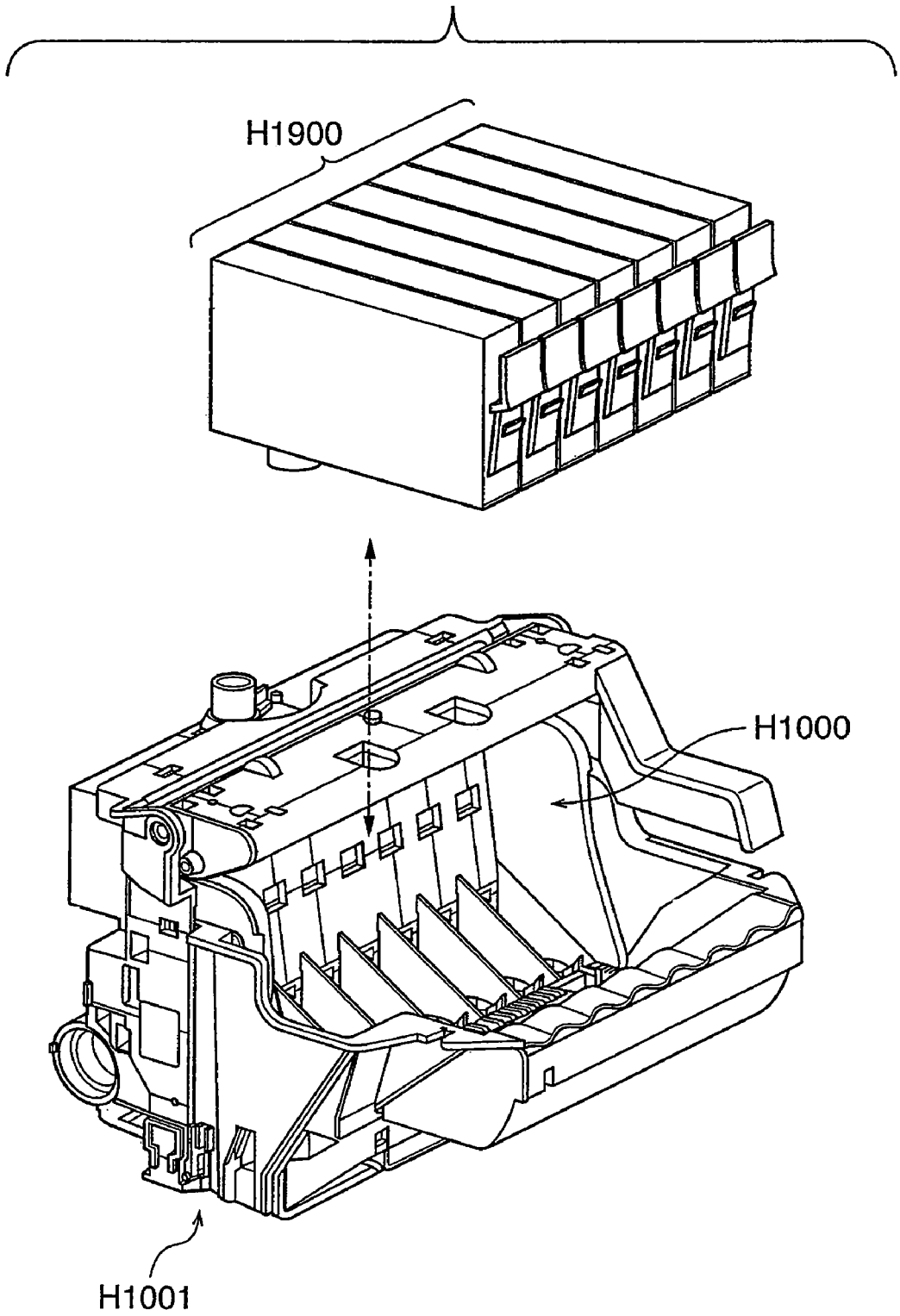
FIG. 5 is a perspective view showing a state in which an ink tank is mounted on a head cartridge.

FIG. 5 is a perspective view showing a state in which the ink tank H1900 is mounted on the head cartridge H1000 used in the first embodiment.

The printing apparatus according to the first embodiment is configured to form an image with inks of seven colors, so ink tanks H1900 are independently prepared for the seven colors. As shown in FIG. 5, each ink tank is freely detachable from the head cartridge H1000. Note that the ink tank H1900 can be dismounted while the head cartridge H1000 is mounted on the carriage M4000.

Figure 6:
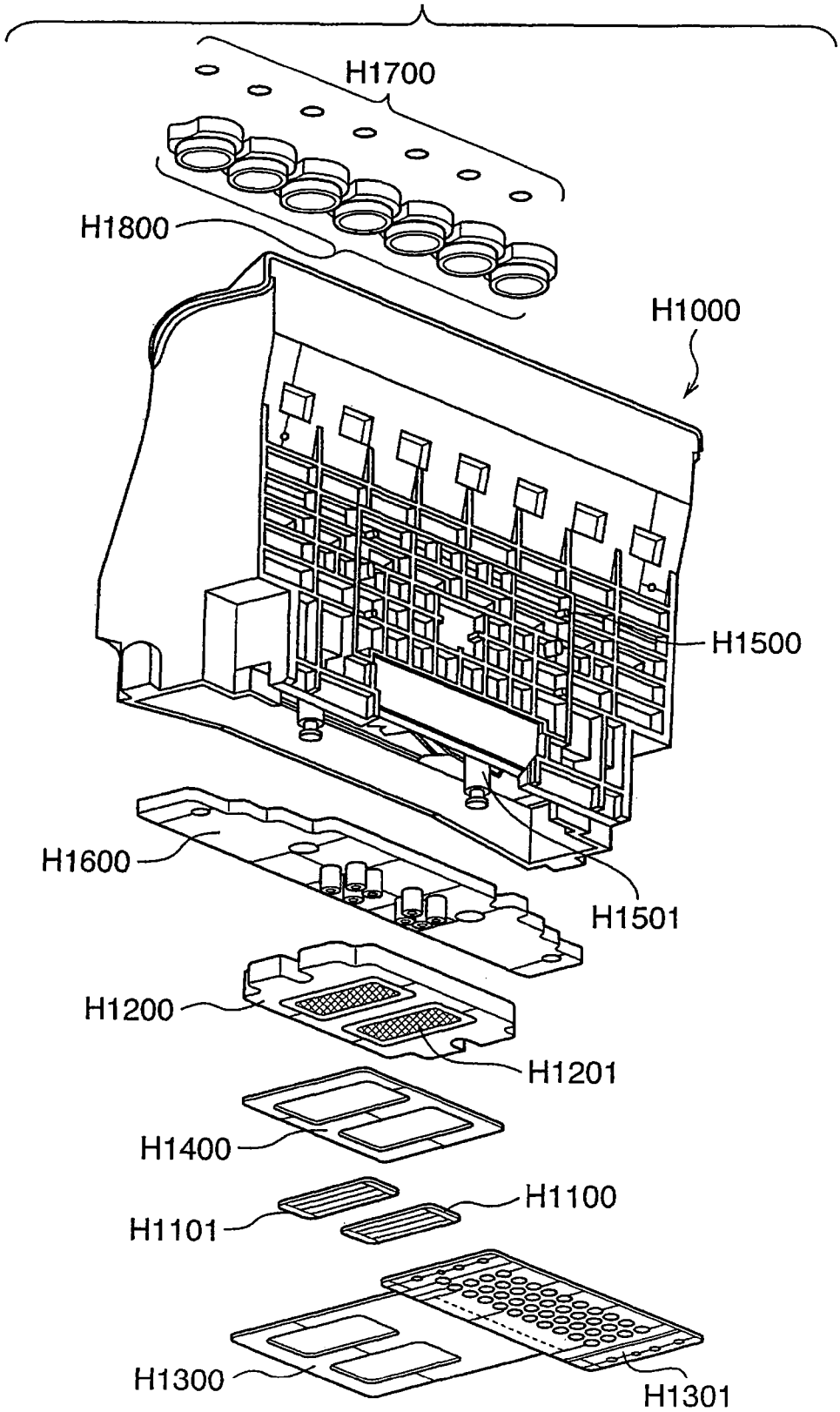
FIG. 6 is an exploded perspective view showing the head cartridge.

FIG. 6 is an exploded perspective view showing the head cartridge H1000.

In FIG. 6, the head cartridge H1000 comprises a first printing element substrate H1100, a second printing element substrate H1101, a first plate H1200, a second plate H1400, an electric wiring substrate H1300, a tank holder H1500, a flow channel forming member H1600, filters H1700, and seal rubbers H1800.

The first and second printing element substrates H1100 and H1101 are Si substrates, on one surface of each of which a plurality of printing elements (nozzles) are formed by photolithography. An electric wire of Al (aluminum) or the like which supplies power to each printing element is formed by a film forming technique. A plurality of ink flow channels corresponding to respective printing elements are also formed by photolithography. An ink supply port for supplying ink to a plurality of ink flow channels is formed to be open in the back surface.

A printing element array (to be also referred to as a nozzle array hereinafter) corresponding to each of different ink colors is formed from 768 nozzles which are aligned at an interval of, e.g., 1,200 dpi (dots/inch) in the printing medium convey direction. An ink droplet of about 2 pL can be discharged at minimum. The opening area of each nozzle discharge orifice is set to about 100 $\mu M^2$. The first and second printing element substrates H1100 and H1101 are bonded and fixed to the first plate H1200. In the first plate H1200, ink supply ports H1201 for supplying ink to the first and second printing element substrates H1100 and H1101 are formed.

The second plate H1400 having openings is bonded and fixed to the first plate H1200. The second plate H1400 holds the electric wiring substrate H1300 so that the electric wiring substrate H1300 is electrically connected to the first and second printing element substrates H1100 and H1101.

The electric wiring substrate H1300 supplies an electrical signal for discharging ink from nozzles formed on the first and second printing element substrates H1100 and H1101. The electric wiring substrate H1300 has electrical wires corresponding to the first and second printing element substrates H1100 and H1101, and an external signal input terminal H1301 which is positioned at the end of the electrical wire and receives an electrical signal from the printing apparatus main body. The external signal input terminal H1301 is positioned and fixed on the rear surface of the tank holder H1500.

The flow channel forming member H1600 is fixed by, e.g., ultrasonic welding to the tank holder H1500 which holds the ink tank H1900. The flow channel forming member H1600 forms ink flow channels H1501 each of which extends from the ink tank H1900 to the first plate H1200.

An end of the ink flow channel H1501 on the ink tank side that engages with the ink tank H1900 is covered with a corresponding filter H1700 to prevent entrance of external dust and dirt. The seal rubber H1800 is attached to a portion engaged with the ink tank H1900 to prevent evaporation of ink from the engaged portion.

A tank holder part made up of the tank holder H1500, flow channel forming member H1600, filters H1700., and seal rubbers H1800 is coupled by bonding or the like to the ink-jet printhead H1001 made up of the first printing element substrate H1100, second printing element substrate H1101, first plate H1200, electric wiring substrate H1300, and second plate H1400, thereby forming the head cartridge H1000.

Figure 7:
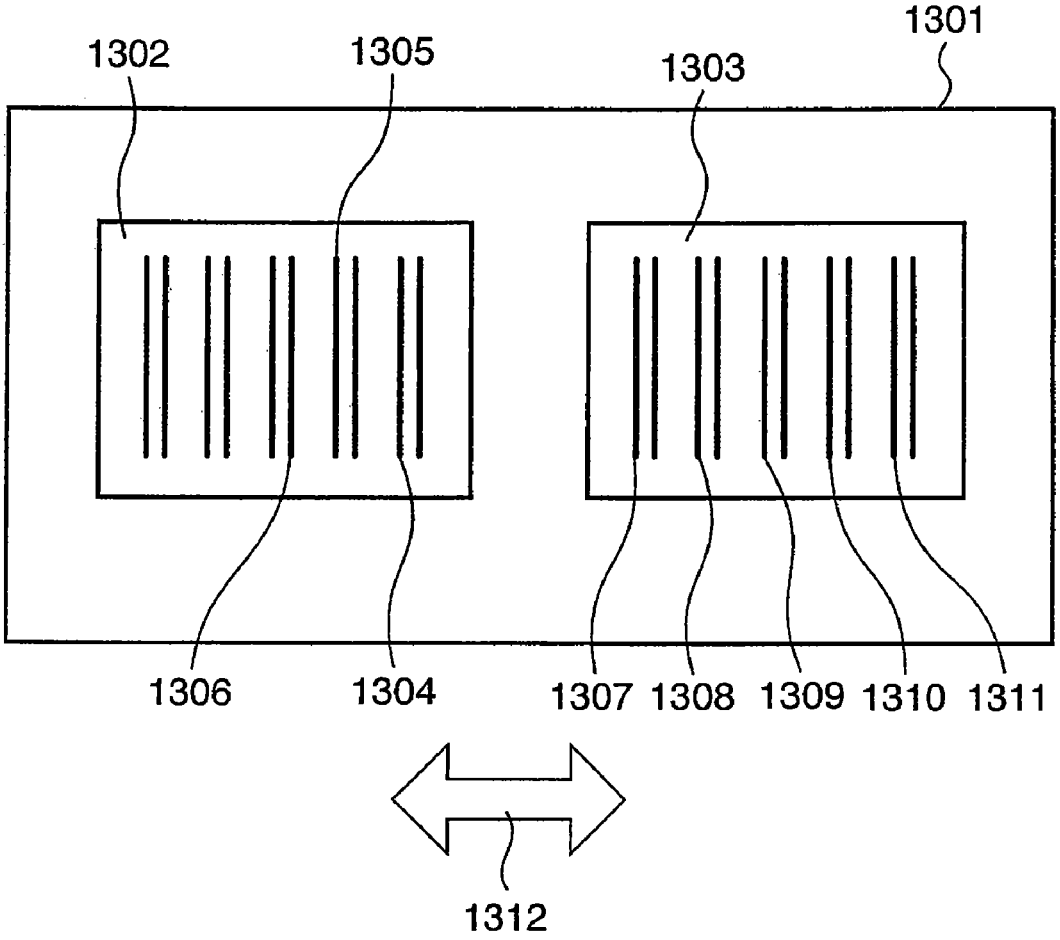
FIG. 7 is a view showing the nozzle arrangement of the ink-jet head.

FIG. 7 is a view showing the nozzle arrangement of the ink-jet printhead according to the first embodiment of the present invention.

Reference numeral 1301 denotes an ink-jet printhead; 1302, an ink-jet head building portion capable of high-speed full-color printing; and 1303, an ink-jet head building portion capable of high-quality printing.

The ink-jet head building portion 1302 capable of high-speed full-color printing has nozzles for discharging cyan ink, magenta ink, and yellow ink which are coloring materials of three primary colors for reproducing full colors by subtractive color mixture. Nozzles for discharging these inks are formed into nozzle arrays 1304, 1305, and 1306 in each of which a plurality of nozzles are arrayed in a direction (to be also referred to as a convey direction) almost perpendicular to a scanning direction 1312 of the ink-jet head. For one color ink, a pair of two nozzle arrays is arranged.

In the ink-jet head building portion 1303 capable of high-quality printing, nozzle arrays for discharging light cyan ink and light magenta ink are arranged as nozzle arrays 1307 and 1311 in order to improve tone reproduction of an output image. In order to increase the contrast of an output image, a nozzle array for discharging black ink is arranged as a nozzle array 1309. Further, the first embodiment employs two special inks (special ink 1 and special ink 2) in order to reproduce a color gamut which cannot be reproduced by only the three, cyan, magenta, and yellow primary colors. The ink-jet head building portion 1303 comprises nozzle arrays 1308 and 1310 for discharging these two special inks. Also in the ink-jet head building portion 1303, similar to the ink-jet head building portion 1302, each of the ink nozzle arrays 1307 to 1311 is formed from a pair of two arrays.

Figure 8:
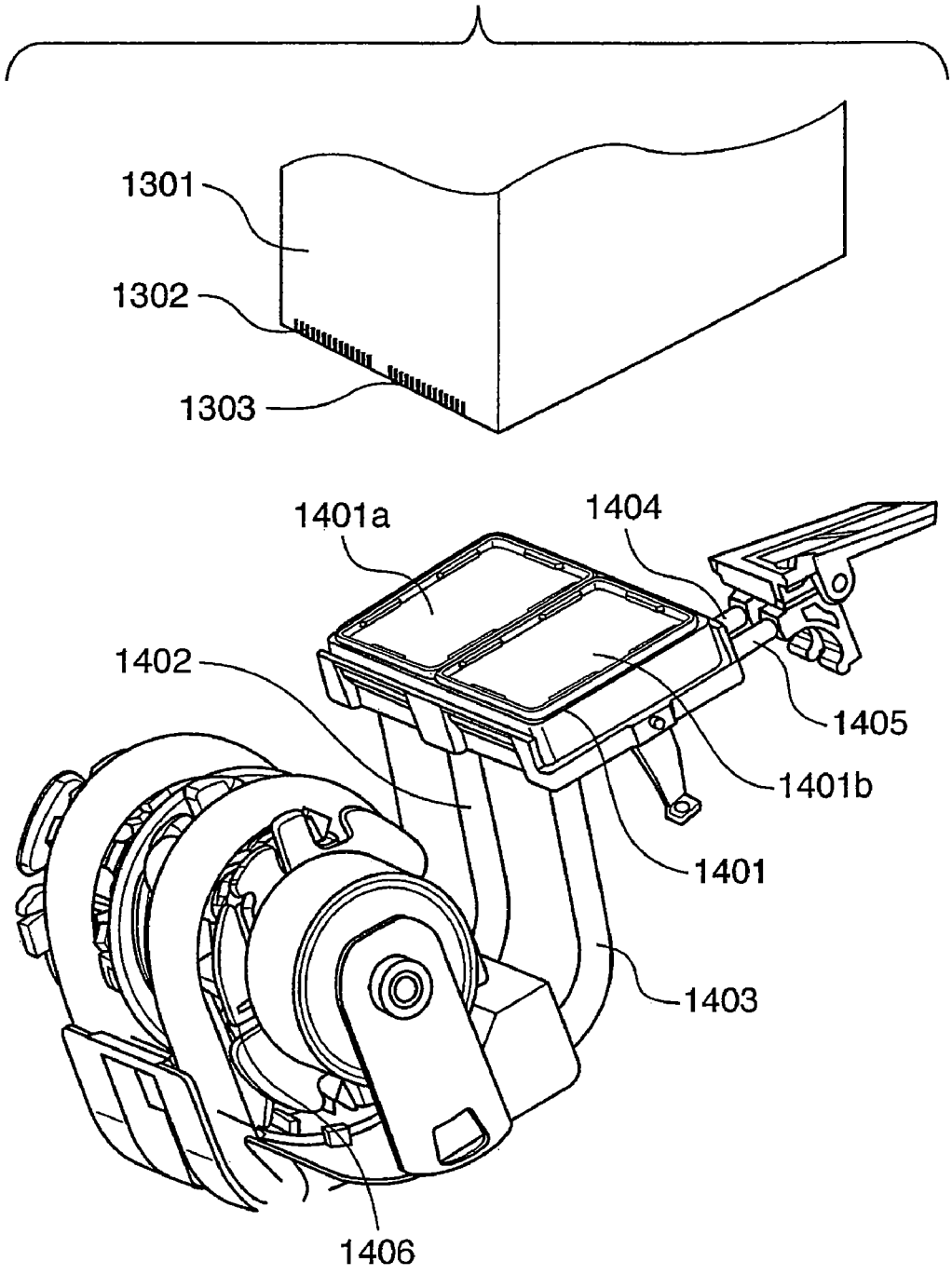
FIG. 8 is a view showing a state in which an ink-jet head building portion capable of high-speed full-color printing and an ink-jet head building portion capable of high-quality printing are separated from each other.

FIG. 8 is a view showing maintenance systems for the respective ink-jet head building portions 1302 and 1303.

Reference numeral 1401 denotes a suction cap which has two chambers 1401*a* and 1401*b* so as to cap the ink-jet head building portions 1302 and 1303. The suction cap 1401 can be abutted or pressed against a surface of the ink-jet head building portion on which nozzles are formed. The chambers 1401*a* and 1401*b* of the suction cap 1401 have air open valves 1404 and 1405, respectively. Further, ink discharge tubes 1402 and 1403 are independently connected to the respective chambers 1401*a* and 1401*b* of the suction cap 1401. If suction pumps are independently arranged for the respective ink discharge tubes 1402 and 1403, the maintenance system becomes bulky, increasing the apparatus size and cost. To prevent this, in the first embodiment, one suction pump 1406 is arranged for the two ink discharge tubes 1402 and 1403. That is, the chambers 1401*a* and 1401*b* of the suction cap 1401, the air open valves 1404 and 1405, and the ink discharge tubes 1402 and 1403 are independently arranged in correspondence with the respective ink-jet head building portions 1302 and 1303. To the contrary, the ink-jet head building portions 1303 and 1302 share the suction pump. In the suction recovery operation, only an air open valve arranged for a suction cap chamber corresponding to an ink-jet head building portion subjected to suction recovery is closed. An air open valve arranged for a suction cap chamber corresponding to an ink-jet head building portion not subjected to suction recovery is opened. The ink-jet head building portion subjected to suction recovery can, therefore, be selected.

A surface of the ink-jet head building portion 1302 in which ink discharge orifices are formed is capped with the suction cap 1401, and the air open valve 1404 (also called an air communication valve). corresponding to the ink-jet head building portion 1302 is closed. In this state, the suction pump 1406 is pivoted to suck ink from the chamber 1401*a* of the suction cap 1401 or ink from the nozzles of the ink-jet head building portion 1302. This operation is called a suction operation. By performing the suction operation, the ink discharge state of the ink-jet head building portion 1302 can be kept good.

The suction operation is similarly performed for the ink-jet head building portion 1303. In the first embodiment, the suction cap 1401 can cap both the ink-jet head building portions 1302 and 1303. The suction cap may also be divided into two so as to separately cap the ink-jet head building portions 1302 and 1303.

Figure 9:
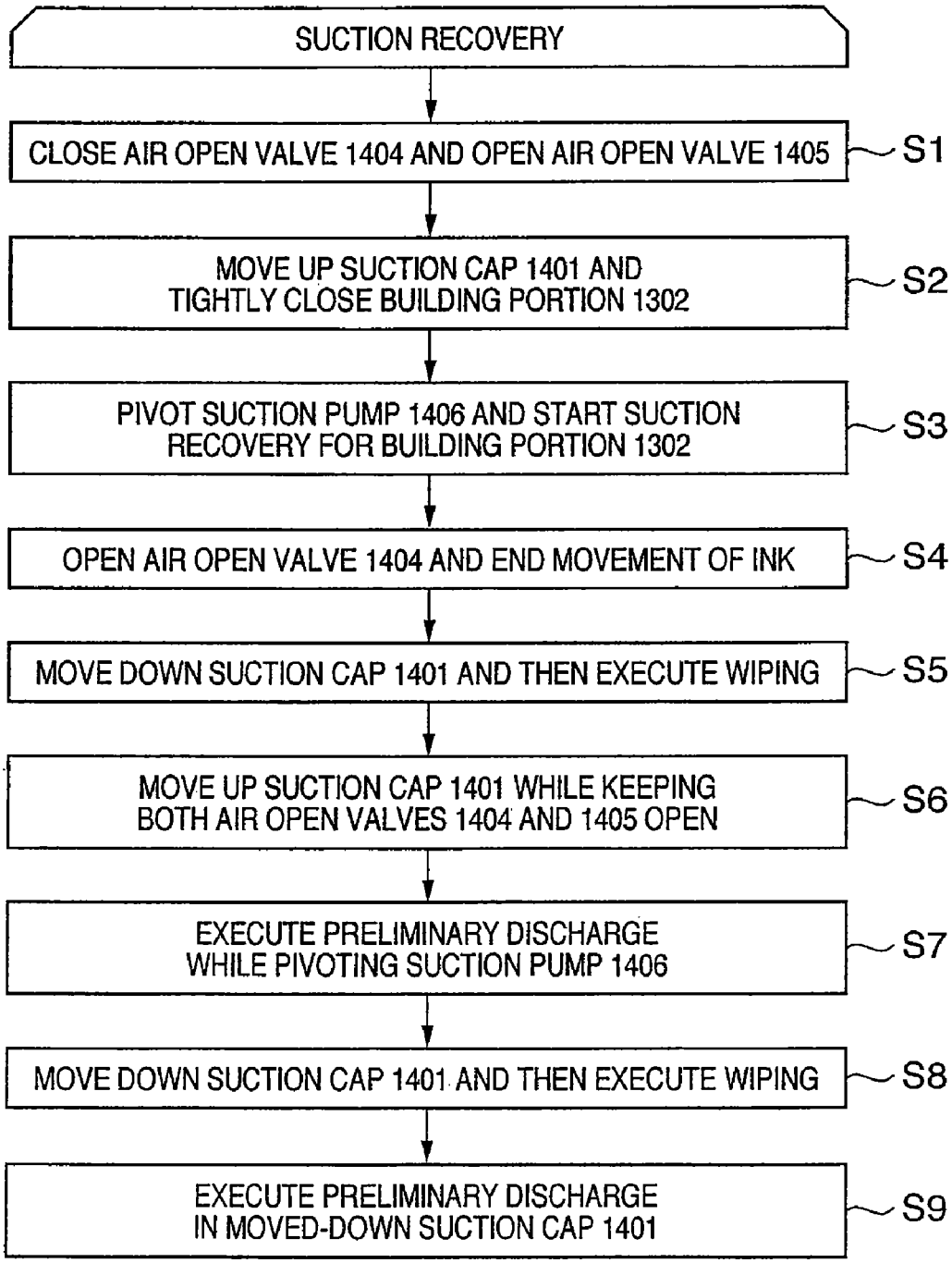
FIG. 9 is a flowchart for explaining an operation sequence when only the ink-jet head building portion capable of high-speed full-color printing is sucked and recovered.

FIG. 9 is a flowchart showing an operation sequence when the suction recovery operation is executed for only the ink-jet head building portion 1302.

Although not shown in FIG. 8, the operation of the suction cap or the like in suction recovery is controlled by pivoting of the cam shaft and gear driving.

The air open valve 1404 is closed, and the air open valve 1405 is opened (step S1).

The suction cap 1401 is moved up and pressed against the ink-jet head 1301 to cap a surface of the ink-jet head 1301 on which the nozzles are formed (step S2). In step S2, only the chamber 1401*a* of the suction cap 1401 that corresponds to the ink-jet head building portion 1302 is tightly closed.

The suction pump 1406 coupled to the two ink discharge tubes 1402 and 1403 is pivoted to suck and recover the ink-jet head building portion 1302 (step S3). At this time, the chamber 1401*b* of the suction cap 1401 that corresponds to the ink-jet head building portion 1303 only sucks air through the air open valve 1405. The ink-jet head building portion 1303 is not recovered, and only the ink-jet head building portion 1302 is sucked. The rotation amount of the suction pump is preferably changed in accordance with the maintenance purpose (ink amount discharged from the ink-jet head 1301).

After the end of the predetermined suction operation, the air open valve 1404 is opened to introduce air into the chamber 1401*a* of the suction cap 1401 which has tightly closed the ink-jet head building portion 1302. Movement of ink in the ink-jet head 1301 ends (step S4).

The suction cap 1401 is moved down, and a wiping operation is performed to wipe remaining ink droplets from the surface of the ink-jet head building portion 1302 (step S5).

While both the air open valves 1404 and 1405 are kept open, the suction cap 1401 is moved up (step S6).

While the interior of the suction cap 1401 abutted against the ink-jet head 1301 communicates with air, the suction pump 1406 is pivoted to preliminarily discharge ink from the ink-jet head building portion 1302 (step S7). The purpose of the operation in step S7 is to prevent internal contamination of the apparatus by spraying, into the apparatus, an ink mist generated upon preliminary discharge.

The suction cap 1401 is moved down again, and wiping is performed to wipe remaining ink droplets from the surface of the ink-jet head building portion 1302 (step S8). Preliminary discharge is executed in the moved-down suction cap 1401 (step S9), and a series of operations of suction recovery ends.

By this operation, the ink-jet head building portions 1302 and 1303 can be selectively sucked and recovered. To simultaneously suck and recover the ink-jet head building portions 1302 and 1303, both the air open valves 1404 and 1405 are closed to execute the above-described series of recovery operations. After step S9, the suction pump 1406 may be pivoted to suck ink preliminarily discharged into the suction cap 1401.

Note that the first embodiment has described a case wherein the ink-jet head building portion 1302 capable of high-speed full-color printing is mainly sucked and recovered. The above description also applies to a case wherein the ink-jet head building portion 1303 capable of high-quality printing is mainly sucked and recovered.

As described above, the ink-jet head is divided into the ink-jet head building portion 1302 capable of high-speed full-color printing and the ink-jet head building portion 1303 capable of high-quality printing. Each ink-jet head building portion can be independently sucked and recovered. With this arrangement, the number of ink tanks (or nozzle arrays) sucked and recovered together in exchanging a tank can be reduced from all eight colors to five or three colors, reducing the consumption of ink in suction recovery.

In the flowchart shown in FIG. 9, wiping and preliminary discharge after the suction operation in step S3 are performed for only an ink-jet head building portion having undergone suction recovery. Alternatively, when one ink-jet head building portion is sucked and recovered, and the nozzle forming surface of the other ink-jet head building portion is contaminated, wiping and preliminary discharge after the suction operation may be executed for the two ink-jet head building portions.

Figure 10:
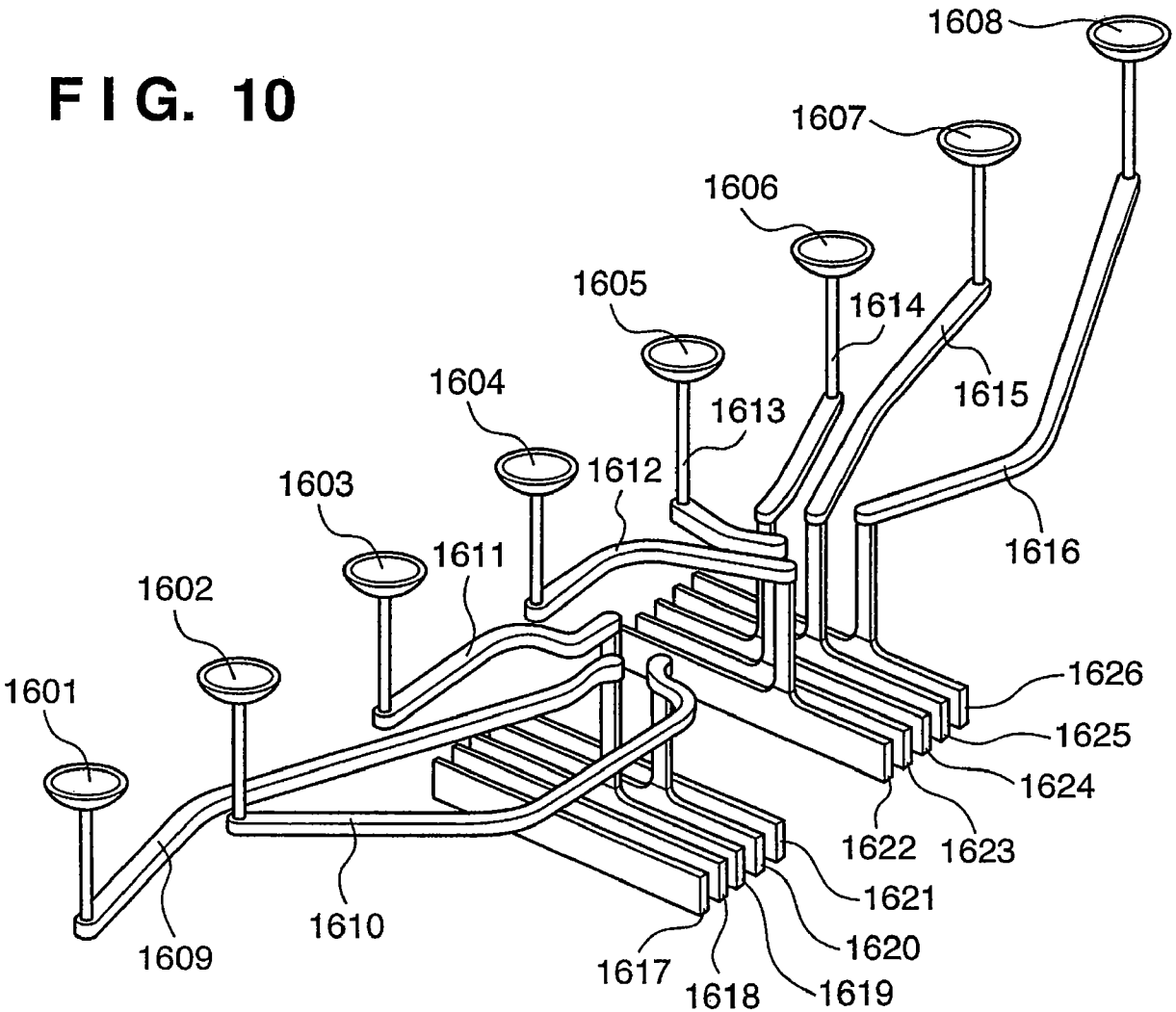
FIG. 10 is a view showing an ink flow channel from an ink tank to an ink discharge orifice.

FIG. 10 is a view showing the schematic structure of an ink flow channel from an ink tank to an ink discharge orifice.

In FIG. 10, reference numerals 1601 to 1608 denote filters to which ink tanks are coupled at upper portions. An yellow ink tank, magenta ink tank, cyan ink tank, light cyan ink tank, special ink 1 tank, black ink tank, special ink 2 tank, and light magenta ink tank (not shown) are coupled to the filters 1601 to 1608 in the order named.

In FIG. 10, reference numerals 1609 to 1616 denote supply channels for supplying inks from the ink tanks. In FIG. 10, reference numerals 1617 to 1626 denote liquid chambers which are arranged to stably distribute and supply inks to laid-out nozzles, and have the same shape and size. Note that the liquid chambers 1617 and 1618 are formed but not connected to any pipe.

More specifically, in the above-described building portion (building portion having discharge nozzles for cyan, magenta, and yellow inks) 1302 capable of high-speed full-color printing, channels for flowing ink are made up of the filters 1601 to 1603, supply channels 1609 to 1611, and liquid chambers 1619 to 1621 in FIG. 10. In the building portion (building portion having discharge nozzles for black ink, light cyan ink, light magenta ink, special ink 1, and special ink 2) 1303 capable of high-quality printing, channels for flowing ink are made up of the filters 1604 to 1608, supply channels 1612 to 1616, and liquid chambers 1622 to 1626.

In the first embodiment, the examination of ink flow rates which should be generated in the ink discharge tubes 1402 and 1403 in accordance with the purpose of performing suction recovery will be explained.

The present inventors found that there are roughly two types of ink flow rates which should be generated in suction recovery. One flow rate type is used when a blank ink flow channel or liquid chamber is refilled with ink, or bubbles present in the ink flow channel or liquid chamber are to be removed. The other flow rate type is used when high-viscosity ink upon evaporation near discharge orifices for discharging ink is replaced with new ink, or bubbles present in discharge orifices for discharging ink are to be removed.

In the former case, ink flow rates to be generated in the ink discharge tubes 1402 and 1403 must be separately optimized, and the ink discharge tubes 1402 and 1403 cannot be simultaneously sucked and recovered. In the latter case, ink flow rates to be generated in the ink discharge tubes 1402 and 1403 suffice to be equal to each other, in other words, the ink discharge tubes 1402 and 1403 can be simultaneously sucked and recovered.

A suction method when a blank ink flow channel or liquid chamber is refilled with ink, or bubbles present in the ink flow channel or liquid chamber are to be removed will be explained. The ink-jet printing apparatus executes this operation when it stands still for a long time or ink is completely consumed.

In this case, the flow rate of ink flowing through the ink flow channel and liquid chamber is important. If the flow rate is too low, a large volume of air remains in the liquid chamber in refilling, or bubbles present in the liquid chamber or the like hardly move and cannot be removed. If the flow rate is too high, unwanted air is entrapped from, e.g., the joint between the ink tank and the ink-jet head to increase bubbles in the liquid chamber.

In the first embodiment, the dimensions of the ink flow channels and liquid chambers of laid-out systems are almost equal to each other, and ink flow rates necessary for the respective systems are determined almost uniquely. To suck the building portion 1302 in which the ink flow channels and liquid chambers of the three, cyan, magenta, and yellow systems are arranged and high-speed full-color printing is possible, the suction pump 1406 is driven so that the ink flow rate of the ink discharge tube 1402 becomes three times higher than that necessary for one system. To suck the building portion 1303 in which the ink flow channels and liquid chambers of the five, black, light cyan, light magenta, special ink 1, and special ink 2 systems are arranged and high-quality printing is possible, the suction pump 1406 is driven so that the ink flow rate of the ink discharge tube 1403 becomes five times higher than that necessary for one system.

Since the discharge tubes 1402 and 1403 are identical in the suction pump 1406 according to the first embodiment, the volumes of the tubes 1402 and 1403 similarly change upon driving the suction pump 1406. Thus, ink must be sucked to set the ink flow rate in the ink discharge tube 1402 and that in the ink discharge tube 1403 to a ratio of 3:5. For this purpose, the suction pump 1406 is driven sequentially twice to generate different ink flow rates in the discharge tubes 1402 and 1403.

Figure 11:
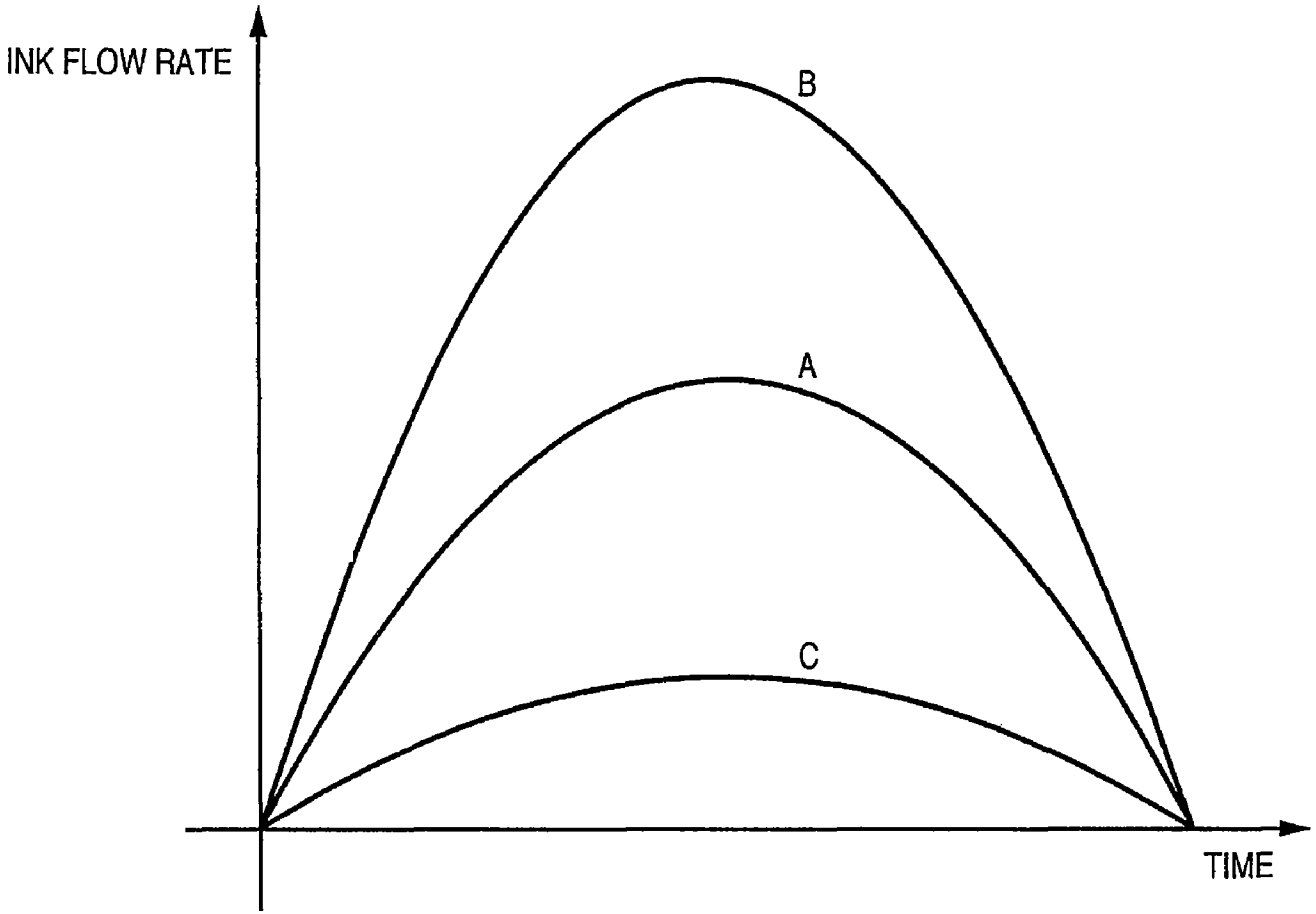
FIG. 11 is a graph showing a change of the ink flow rate over time when the recovery operation is done by driving a pump sequentially twice.

FIG. 11 is a graph showing a change of the ink flow rate over time when the time is plotted along the X-axis, the ink flow rate is plotted along the Y-axis, and the recovery operation is done by driving the pump sequentially twice.

A curve A represents a change over time in the ink flow rate of the discharge tube 1402 in the ink-jet head building portion 1302 capable of high-speed full-color printing.

A curve B represents a change over time in the ink flow rate of the discharge tube 1403 in the ink-jet head building portion 1303 capable of high-quality printing.

A curve C represents a change over time in the ink flow rates of the ink supply channels 1609 to 1616.

By driving the pump sequentially twice, ink flow rates in respective ink supply channels can be set to almost the same value regardless of the head building portion.

The three curves in the first embodiment have the following relationship:

$$A \approx 3C,\ B \approx 5C$$

The concept of an ink flow rate generated by driving the pump sequentially twice will be explained with reference to FIGS. 12A and 12B.

Figures 12A, 12B:
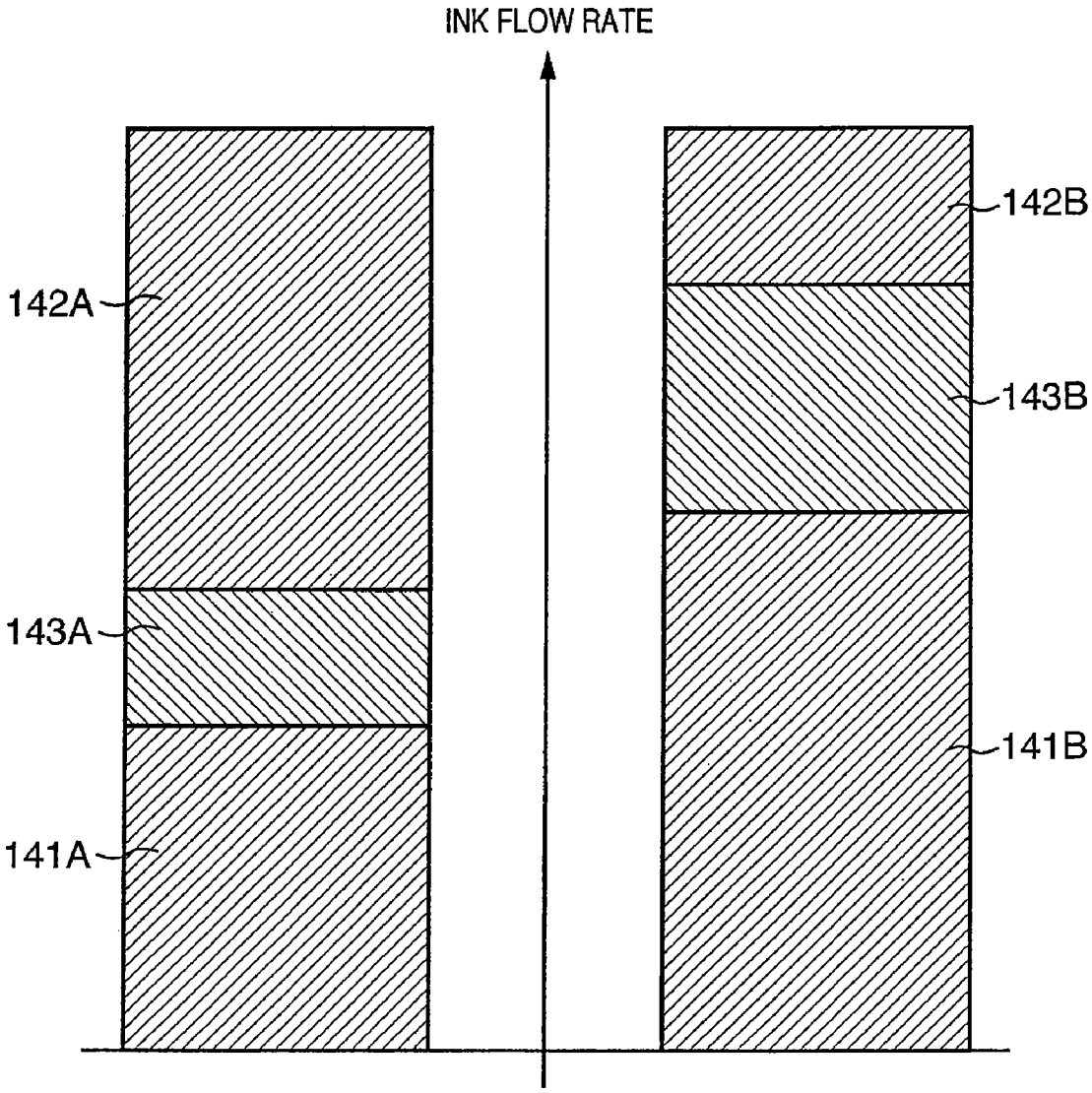
FIGS. 12A and 12B are conceptual views showing an ink flow rate generated by driving the pump sequentially twice.

FIG. 12A shows an ink flow rate necessary for the discharge tube 1402 in the ink-jet head building portion 1302 capable of high-speed full-color printing. Reference symbol 141A denotes an area where the ink flow rate is too low and a blank liquid chamber or the like cannot be satisfactorily refilled. Reference symbol 142A denotes an area where the ink flow rate is too high and unwanted air is entrapped from, e.g., the joint between the ink tank and the ink-jet head to increase bubbles in the liquid chamber. Reference symbol 143A denotes an area (corresponding to the curve A in FIG. 11) where an ink flow rate capable of achieving the purpose without the above-mentioned problems is generated.

FIG. 12B shows an ink flow rate necessary for the discharge tube 1403 in the ink-jet head building portion 1303 capable of high-quality printing. Reference symbol 141B denotes an area where the ink flow rate is too low and a blank liquid chamber or the like cannot be satisfactorily refilled. Reference symbol 142B denotes an area where the ink flow rate is too high and unwanted air is entrapped from, e.g., the joint between the ink tank and the ink-jet head to increase bubbles in the liquid chamber. Reference symbol 143B denotes an area (corresponding to the curve B in FIG. 11) where an ink flow rate capable of achieving the purpose without the above-mentioned problems is generated.

As is apparent from a comparison between the areas 143A and 143B, the ink-jet head building portions 1302 and 1303 do not have any common ink flow rate. This is because the ink-jet head building portion 1302 has the ink flow channels of the three systems, as described above, and requires a lower ink flow rate (area 143A), while the ink-jet head building portion 1303 has the ink flow channels of the five systems, as described above, and requires a higher ink flow rate (area 143B). From this, it turns out that the ink-jet head building portions 1302 and 1303 cannot be simultaneously sucked.

A suction method when high-viscosity ink upon evaporation near discharge orifices for discharging ink is replaced with new ink, or bubbles present in discharge orifices for discharging ink are to be removed will be explained. The ink-jet printing apparatus executes this operation when it stands still for a long time or bubbles are generated in discharge orifices during printing, causing a discharge failure.

In this case, it is important to break the meniscus of the ink discharge orifice and move bubbles in the discharge orifice. Power which breaks the meniscus is a pressure which is generated in the suction cap 1401 when the suction pump 1406 is driven. At this time, the suction cap 1401 is divided into the two chambers 1401*a* and 1401*b*, which correspond to the building portions 1302 and 1303, respectively. Since the two chambers 1401*a* and 1401*b* are equal in size, the same pressure is applied to the two building portions when both the air open valves 1404 and 1405 are closed to drive the pump. That is, the pump suffices to be driven once when the two building portions are sucked.

Figure 13:
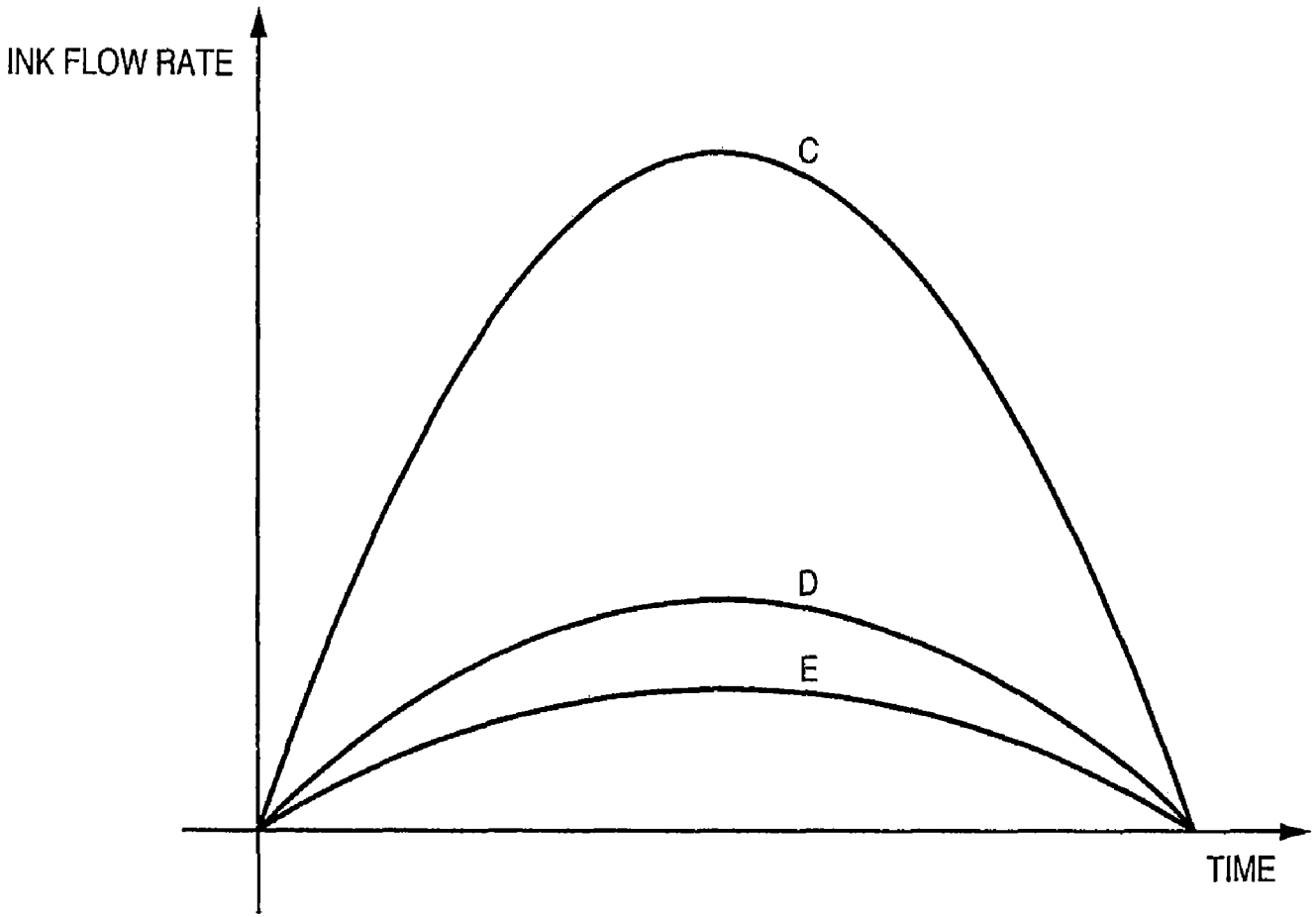
FIG. 13 is a graph showing a change of the ink flow rate over time when the recovery operation is done by driving the pump once.

FIG. 13 is a graph showing a change of the ink flow rate over time when the time is plotted along the X-axis, the ink flow rate is plotted along the Y-axis, and the recovery operation is done by driving the pump once.

A curve C represents a change over time in the ink flow rate of the discharge tube 1402 in the ink-jet head building portion 1302 capable of high-speed full-color printing, and a change over time in the ink flow rate of the discharge tube 1403 in the ink-jet head building portion 1303 capable of high-quality printing. As shown in FIG. 13, the change over time in the ink flow rate of the discharge tube in simultaneous suction is identical between the discharge tubes 1402 and 1403.

A curve D represents a change over time in the ink flow rates of the ink supply channels 1609, 1610, and 1611 in the ink-jet head building portion 1302 capable of high-speed full-color printing. A curve E represents a change over time in the ink flow rates of the ink supply channels 1612, 1613, 1614, 1615, and 1616 in the ink-jet head building portion 1303 capable of high-quality printing.

It is apparent that, when the pump is driven once, the ink flow rate in the ink supply channel changes depending on the building portion. However, negative pressures generated in suction caps corresponding to the respective building portions become almost equal, similar to the curve C.

The three curves in the first embodiment have the following relationship:

$$D \approx (1/3)C,\ E \approx (1/5)C$$

The concept of an ink flow rate generated by driving the pump once will be explained with reference to FIGS. 14A and 14B.

Figures 14A, 14B:
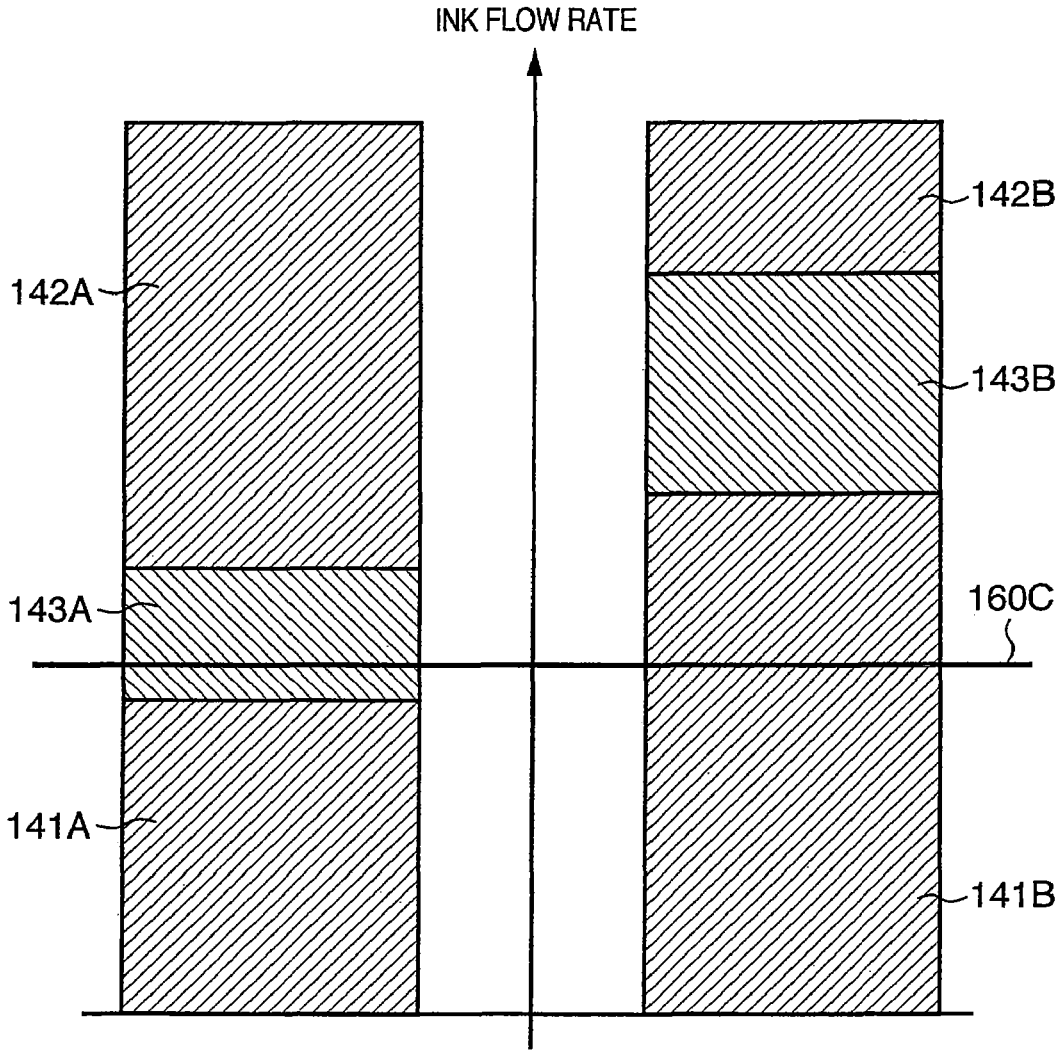
FIGS. 14A and 14B are conceptual views showing an ink flow rate generated by driving the pump once.

Similar to FIG. 12A, FIG. 14A shows an ink flow rate necessary for the discharge tube 1402 in the ink-jet head building portion 1302 capable of high-speed full-color printing. Reference symbol 141A denotes an area where the ink flow rate is too low and a blank liquid chamber or the like cannot be satisfactorily refilled. Reference symbol 142A denotes an area where the ink flow rate is too high and unwanted air is entrapped from, e.g., the joint between the ink tank and the ink-jet head to increase bubbles in the liquid chamber.

FIG. 14B shows an ink flow rate necessary for the discharge tube 1403 in the ink-jet head building portion 1303 capable of high-quality printing. Reference symbol 141B denotes an area where the ink flow rate is too low and a blank liquid chamber or the like cannot be satisfactorily refilled. Reference symbol 142B denotes an area where the ink flow rate is too high and unwanted air is entrapped from, e.g., the joint between the ink tank and the ink-jet head to increase bubbles in the liquid chamber.

A line 160C over FIGS. 14A and 14B represents an ink flow rate corresponding to the curve C in FIG. 13 when the pump is driven once in the first embodiment. This pump driving can break the meniscus of the ink discharge orifice and move bubbles in the discharge orifice.

When the pump is driven sequentially twice, as described above, ink flow rates in the areas 143A and 143B are generated in the respective building portions. To the contrary, when the pump is driven once, a predetermined pressure suffices to be generated in the suction cap 1401. Neither blank ink flow channel nor liquid chamber needs be refilled with ink, or bubbles present in the ink flow channel or liquid chamber need not be removed, so no problem occurs even if the line 160C lies across the area 141B.

How to actually switch between the two driving methods in the ink-jet printing apparatus will be explained.

The pump is driven sequentially twice when a blank ink flow channel or liquid chamber is refilled with ink, or bubbles present in the ink flow channel or liquid chamber are to be removed. This state occurs when an ink-jet head is mounted for the first time after the ink-jet printing apparatus is purchased, when the ink-jet head has not been used for a long time, or when the ink-jet head has been used until ink in the ink tank runs short.

In the first embodiment, the printing apparatus main body and main body control program are equipped with a determination device capable of determining whether the ink-jet head is mounted for the first time, the elapsed time when the ink-jet head is not used exceeds a threshold, or the ink-jet head has been used until ink in the ink tank runs short. If the determination device determines "Yes", the pump is driven sequentially twice.

Figure 16:
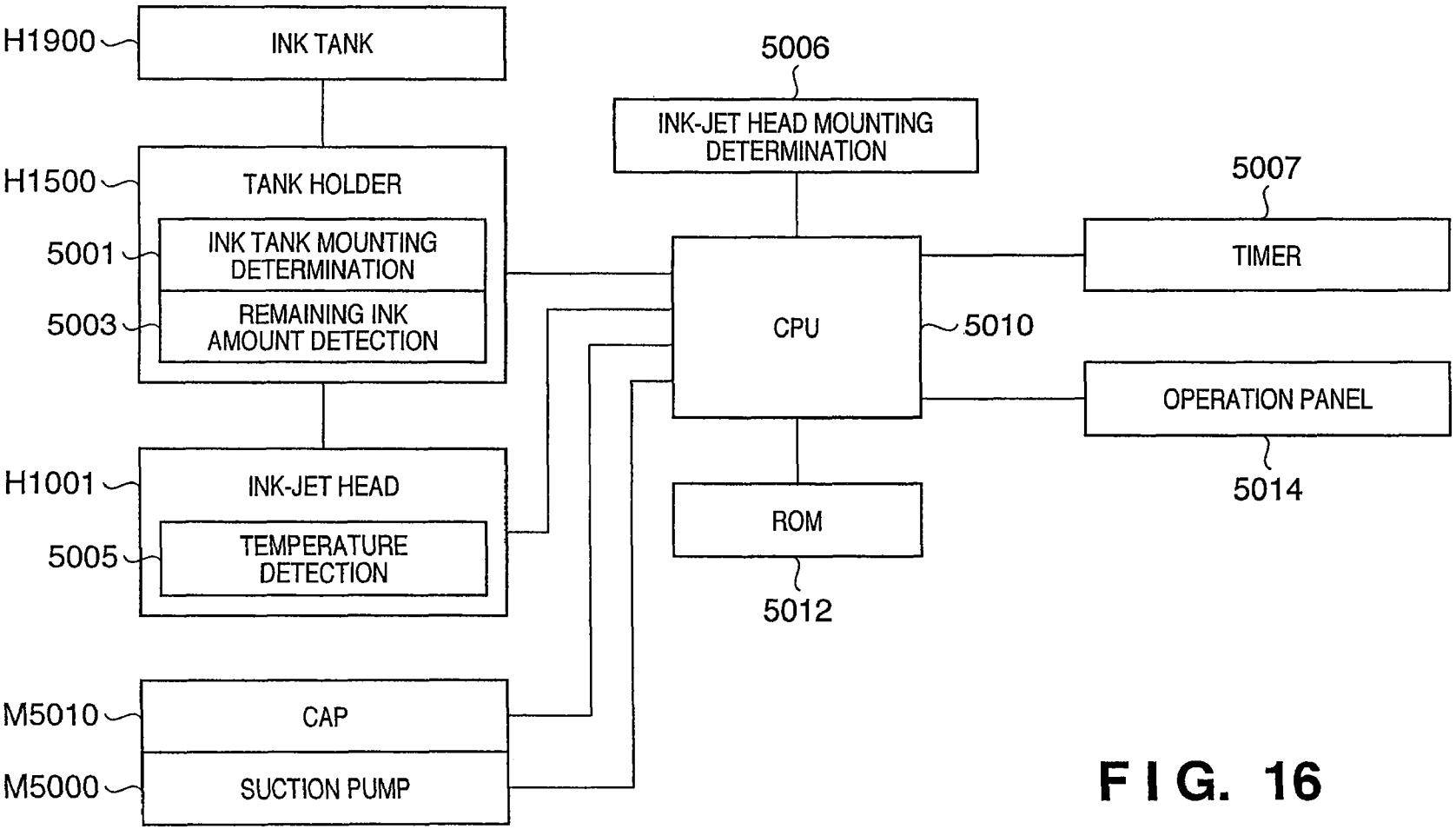
FIG. 16 is a block diagram showing the printing apparatus main body.

The determination device is configured as follows. More specifically, as shown in FIG. 16 which is a block diagram of the printing apparatus main body, the printing apparatus main body comprises an ink-jet head mounting determination unit 5006 which determines whether the ink-jet head is mounted. On the basis of a control program stored in a ROM 5012 and the detection result of the ink-jet head mounting determination unit, a CPU 5010 determines whether the ink-jet head is mounted for the first time. As a method of determining whether the ink-jet head is mounted for the first time, for example, when it is detected that the ink-jet head is mounted, the printing apparatus reads information (e.g., a serial number) capable of identifying an individual ink-jet head, and compares the read information with individual identification information of the ink-jet head used that is stored in the internal memory of the printing apparatus. The printing apparatus can acquire individual identification information of the ink-jet head by printing individual identification information in a barcode on the ink-jet head or mounting, in the ink-jet head, a memory (IC or ROM) which stores individual identification information. On the basis of the detection results of a remaining ink amount detection unit 5003 and ink tank mounting determination unit 5001, the CPU 5010 determines whether the ink-jet head has been used until ink in the ink tank runs short, or the ink-jet head has been exchanged. On the basis of the time measured by a timer 5007, the CPU 5010 determines whether the elapsed time when the ink-jet head is not used exceeds a threshold.

To the contrary, the pump is driven once in order to prevent a change of the tint of a printed material when high-viscosity ink upon evaporation near discharge orifices for discharging ink is replaced with new ink, or prevent any stripe or the like formed by an ink discharge failure when bubbles present in discharge orifices for discharging ink are removed. This state occurs when the ink-jet head is not used for a short time, or accidentally occurs during printing.

In the first embodiment, the printing apparatus main body and main body control program are equipped with the determination device capable of determining whether the elapsed time when the ink-jet head is not used exceeds a threshold, the continuous printing time exceeds a threshold, or the printing amount of continuous printing exceeds a threshold. If the determination device determines "Yes", the pump is driven once.

The determination device is configured as follows. More specifically, as shown in FIG. 16 which is a block diagram of the printing apparatus main body, the printing apparatus main body comprises the timer 5007. On the basis of the control program stored in the ROM 5012 and the elapsed time of the timer, the CPU 5010 determines whether the elapsed time when the ink-jet head is not used exceeds a threshold, or the continuous printing time exceeds a threshold. The CPU 5010 monitors the printing amount, and also determines whether the printing amount of continuous printing exceeds a threshold.

In this manner, according to the first embodiment, the method of driving the pump sequentially twice and the method of driving the pump once are switched and used to meet the purpose of sucking the two ink-jet building portions in accordance with the description programmed in the printing apparatus in advance.

The ink system in the first embodiment uses a dye ink system of eight types: cyan, magenta, yellow, black, light cyan, light magenta, special ink 1, and special ink 2 which do not react with each other upon contact. Note that ink is not particularly limited, and all colors can be implemented by dye inks or pigment inks as far as neither the ink discharge performance nor the maintenance is influenced if inks mix with each other.

In the first embodiment, the same negative pressure is generated in the chambers 1401*a* and 1401*b* in recovery processing of moving bubbles in the ink discharge orifice. However, negative pressures generated in the chambers 1401*a* and 1401*b* need not coincide with each other and are permitted to have a small difference as far as bubbles in the ink discharge orifice can be moved. Further, negative pressures suffice to be almost simultaneously generated from the chambers 1401*a* and 1401*b* by driving the pump once in recovery processing of moving bubbles in the ink discharge orifice.

Second Embodiment

The second embodiment of how to switch between the two driving methods in an ink-jet printing apparatus will be described.

The pump is driven sequentially twice when a blank ink flow channel or liquid chamber is refilled with ink, or bubbles present in the ink flow channel or liquid chamber are to be removed. If printing is done in this state, a printed image is greatly disturbed.

In contrast, the pump is driven once in order to prevent a change of the tint of a printed material when high-viscosity ink upon evaporation near discharge orifices for discharging ink is replaced with new ink, or prevent any stripe or the like formed by an ink discharge failure when bubbles present in discharge orifices for discharging ink are removed. If printing is done in this state, no image can be printed in accurate colors or a blank strip stands out.

In the second embodiment, an operation key (arranged on an operation panel 5014 in FIG. 16) capable of outputting printing data which allows the user to visually determine a difference in printing disturbance is prepared for apparatuses capable of directly providing printing data to the ink-jet printing apparatus, such as an application (commonly called a driver) which operates the ink-jet printing apparatus, the operation panel of the ink-jet printing apparatus, and a digital camera.

In the second embodiment, if the user performs arbitrary printing and determines that a printed image is abnormal, the user outputs, through the operation key (arranged on the operation panel 5014 in FIG. 16) capable of outputting printing data, printing data which allows the user to determine a difference in printing disturbance. If the user determines that a serious disturbance occurs, he uses the operation key (arranged on the operation panel 5014 in FIG. 16) to designate execution of driving the pump sequentially twice. If the tint changes or a blank stripe or the like appears, the user uses the operation key to designate execution of driving the pump once.

In this fashion, according to the second embodiment, the user outputs a printed image programmed in the printing apparatus in advance, and checks the printed image to switch between the method of driving the pump sequentially twice and the method of driving the pump once.

The ink system in the second embodiment uses a dye ink system of eight types: cyan, magenta, yellow, black, light cyan, light magenta, special ink 1, and special ink 2 which do not react with each other upon contact. Note that ink is not particularly limited, and all colors can be implemented by dye inks or pigment inks as far as neither the ink discharge performance nor the maintenance is influenced if inks mix with each other.

In the second embodiment, the user checks an output printed image and switches driving of suction recovery. When the printing apparatus comprises a reading device capable of reading a printed image by using an optical sensor or image sensing element, a printed image which is output at a predetermined timing may be read to switch driving of suction recovery.

Third Embodiment

The third embodiment of how to switch between the two driving methods in an ink-jet printing apparatus will be described.

The pump is driven sequentially twice when a blank ink flow channel or liquid chamber is refilled with ink, or bubbles present in the ink flow channel or liquid chamber are to be removed. If a large amount of ink is discharged outside the printing area in this state, the temperature of the ink-jet head quickly rises because of the following reason. When electrical energy is applied in order to discharge ink, it is converted into heat energy by the heater near a discharge orifice in which no ink exists, but no ink is discharged, and the heat energy is accumulated in the ink-jet head.

To the contrary, the pump is driven once in order to prevent a change of the tint of a printed material when high-viscosity ink upon evaporation near discharge orifices for discharging ink is replaced with new ink, or prevent any stripe or the like formed by an ink discharge failure when bubbles present in discharge orifices for discharging ink are removed. If a large amount of ink is discharged outside the printing area in this state, the temperature of the ink-jet head gradually rises, unlike the above-described state. This is because, when electrical energy is applied in order to discharge ink, part of heat energy converted by the heater is discharged outside the ink-jet head by ink discharge, and heat is slowly accumulated in the ink-jet head.

Figure 15:
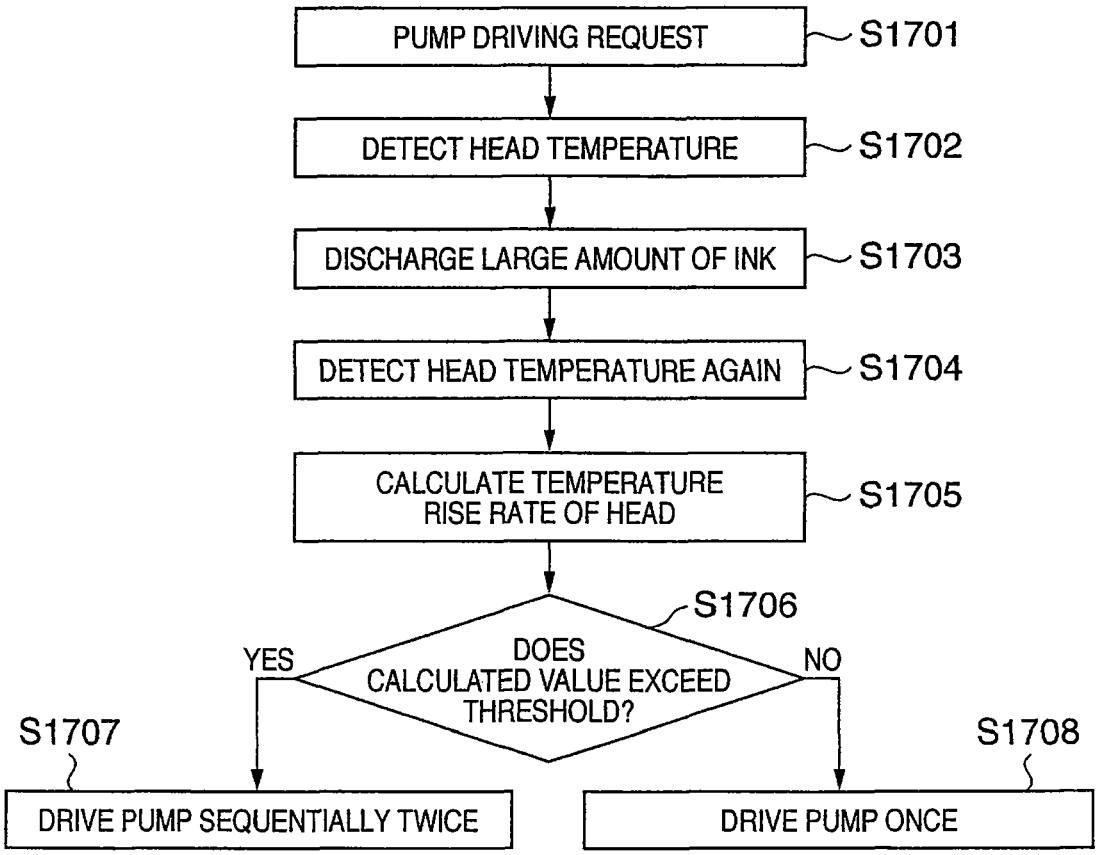
FIG. 15 is a flowchart showing a switching method according to the third embodiment.

FIG. 15 is a flowchart for explaining a switching method according to the third embodiment of the present invention.

If a pump driving request exists in the operation program (stored in a ROM 5012 in FIG. 16) of the ink-jet printing apparatus (step S1701), the temperature of the ink-jet head is detected by a temperature sensor 5005 shown in FIG. 16 (step S1702). Immediately after a large amount of ink is discharged outside the printing area (step S1703), the temperature of the ink-jet head is detected again (step S1704), and the current temperature rise rate is calculated (step S1705). A CPU 5010 determines whether the calculated temperature rise rate value exceeds a threshold (step S1706). If YES in step S1706, the pump is driven sequentially twice (step S1707); if NO, driven once (step S1708).

As described above, according to the third embodiment, the method of driving the pump sequentially twice and the method of driving the pump once are automatically switched and used in accordance with the flow programmed in the printing apparatus in advance.

The ink system in the third embodiment uses a dye ink system of eight types: cyan, magenta, yellow, black, light cyan, light magenta, special ink 1, and special ink 2 which do not react with each other upon contact. Note that ink is not particularly limited, and all colors can be implemented by dye inks or pigment inks as far as neither the ink discharge performance nor the maintenance is influenced if inks mix with each other.

Fourth Embodiment

In the above description, the difference between ink-jet head building portions in the first to third embodiments is based on the numbers of ink tanks, ink flow channels, and liquid chambers belonging to the respective building portions. However, as far as the same effects can be obtained by applying the present invention, this difference may arise from the numbers of ink discharge orifices and discharge nozzles or the diameter, or from a different structure or dimensions even if the numbers of ink tanks, ink flow channels, and liquid chambers belonging to the respective building portions are equal.

In the first to third embodiments, the ink-jet head is divided into two ink-jet head building portions. However, as far as the same effects can be obtained by applying the present invention, the ink-jet head may be divided into more than two building portions.

As described above, according to the above embodiments, the user becomes free from any extra stress by reducing the total consumption of ink in the printing apparatus including the consumption of ink in maintenance, and minimizing the count at which a plurality of ink-jet head building portions are sequentially sucked.

Further, while wasteful consumption of ink in a suction recovery operation is suppressed, prolongation of the time taken for the suction recovery operation can be prevented.

Other Embodiment

The object of the embodiments is achieved even by supplying a storage medium (or recording medium) which records software program codes to implement the functions of the above-described embodiments to the system or apparatus and causing the computer (or CPU or MPU) of the system or apparatus to read out and execute the program codes stored in the storage medium. In this case, the program codes read out from the storage medium implement the functions of the above-described embodiments by themselves, and the storage medium which stores the program codes constitutes the present invention. The functions of the above-described embodiments are implemented not only when the readout program codes are executed by the computer but also when the operating system (OS) or the like running on the computer performs part or all of actual processing on the basis of the instructions of the program codes.

The functions of the above-described embodiments are also implemented when the program codes read out from the storage medium are written in the memory of a function expansion card inserted into the computer or a function expansion unit connected to the computer, and the CPU of the function expansion card or function expansion unit performs part or all of actual processing on the basis of the instructions of the program codes.

When the present invention is applied to the storage medium, the storage medium stores program codes corresponding to the above-described procedures.

The present invention is not limited to the above embodiments and various changes and modifications can be made within the spirit and scope of the present invention. Therefore, to apprise the public of the scope of the present invention the following claims are made.

This application claims the benefit of Japanese Patent Application No. 2005-109223 filed on Apr. 5, 2005, which is hereby incorporated by reference herein in its entirety.

What is claimed is:

1. An ink-jet printing apparatus which prints an image on a print medium using an ink-jet head having at least a first nozzle group and a second nozzle group, comprising:

a first capping device which caps the first nozzle group;

a second capping device which caps the second nozzle group;

a suction device configured to suck ink from the first and second nozzle groups through said first and second capping devices, said suction device being provided commonly for said first and second capping devices; and a controller configured to control a first suction mode for sucking ink simultaneously from the first and second nozzle groups by said suction device and a second suction mode for sucking ink sequentially from the first and second nozzle groups by said suction device, wherein said controller controls to perform the first suction mode in a case that a temperature rise rate when the ink-jet head ejects the ink is not more than a threshold temperature rise rate, and to perform the second suction mode in a case that the temperature rise rate is more than the threshold temperature rise rate.

2. The apparatus according to claim 1, wherein a color of ink ejected from the first nozzle group is different from a color of ink ejected from the second nozzle group.

3. The apparatus according to claim 1, wherein said controller controls one suction mode selected based on a status of usage of the ink-jet head from a plurality of suction modes including the first and second suction modes.

4. An ink-jet printing apparatus which prints an image on a print medium using an ink-jet head including at least a first nozzle group for ejecting a first ink and a second nozzle group for ejecting a second ink different from the first ink, comprising:

a first capping device which caps the first nozzle group;

a second capping device which caps the second nozzle group;

a suction pump configured to suck ink from the first and second nozzle groups by generating a negative pressure in said first and second capping devices, said suction pump being provided commonly for said first and second capping devices; and a controller configured to control a first suction mode for sucking ink from the first and second nozzle groups by generating simultaneously the negative pressure in said first and second capping devices by said suction pump and a second suction mode for sucking ink from the first and second nozzle groups by generating sequentially the negative pressure in said first and second capping devices by said suction pump, wherein said controller controls to perform the first suction mode in a case that a temperature rise rate when the ink-jet head ejects the ink is not more than a threshold temperature rise rate, and to perform the second suction mode in a case that the temperature rise rate is more than the threshold temperature rise rate.

* * * * *